US009938039B2

(12) United States Patent
Nishikawa et al.

(10) Patent No.: US 9,938,039 B2
(45) Date of Patent: Apr. 10, 2018

(54) BOX FOR PACKING AND EXHIBITING PRODUCT, AND PACKING DEVICE THEREFOR

(71) Applicant: RENGO CO., LTD., Osaka (JP)

(72) Inventors: Yoichi Nishikawa, Saitama (JP); Atsuo Ishikawa, Saitama (JP); Takafumi Makiuchi, Saitama (JP); Akira Nagaosa, Osaka (JP); Masayuki Handa, Tokyo (JP); Masanori Yoshida, Tokyo (JP); Hiroyuki Noguchi, Tokyo (JP); Hiromu Ikeda, Osaka (JP); Kazuyuki Ishii, Saitama (JP); Hironori Sugita, Osaka (JP); Tatsuya Fujibayashi, Aomori (JP)

(73) Assignee: Rengo Co., Ltd., Osaka (JP)

( * ) Notice: Subject to any disclaimer, the term of this patent is extended or adjusted under 35 U.S.C. 154(b) by 63 days.

(21) Appl. No.: 15/031,011

(22) PCT Filed: Sep. 30, 2014

(86) PCT No.: PCT/JP2014/076005

§ 371 (c)(1),
(2) Date: Apr. 21, 2016

(87) PCT Pub. No.: WO2015/060073

PCT Pub. Date: Apr. 30, 2015

(65) Prior Publication Data

US 2016/0304236 A1 Oct. 20, 2016

(30) Foreign Application Priority Data

Oct. 24, 2013 (JP) ..... 2013-221069
Nov. 27, 2013 (JP) ..... 2013-244478
(Continued)

(51) Int. Cl.
*B65D 25/54* (2006.01)
*B65D 5/54* (2006.01)
(Continued)

(52) U.S. Cl.
CPC ..... *B65D 5/5445* (2013.01); *B65B 5/024* (2013.01); *B65B 7/16* (2013.01); *B65D 5/16* (2013.01); *B65D 5/4266* (2013.01); *B65D 5/64* (2013.01)

(58) Field of Classification Search
CPC ..... B65D 5/5445; B65D 5/64; B65D 5/16; B65D 5/4266; B65B 5/024; B65B 7/16
(Continued)

(56) References Cited

U.S. PATENT DOCUMENTS 3,917,158 A * 11/1975 Dorofachuk ..... B65D 5/0227 229/164
4,058,206 A * 11/1977 Morse ..... B65D 5/52 229/120.02
(Continued)

FOREIGN PATENT DOCUMENTS

CN 102481997 5/2012
CN 102686486 9/2012
(Continued)

OTHER PUBLICATIONS

International Search Report dated Jan. 6, 2015 in corresponding International Application No. PCT/JP2014/076005 (with English translation).
(Continued)

*Primary Examiner* — Luan K Bui
(74) *Attorney, Agent, or Firm* — Wenderoth, Lind & Ponack, L.L.P.

(57) ABSTRACT

A box includes a front receiving panel, a bottom surface panel, a rear surface panel, a top surface panel, and a front surface panel that are integrally connected one to another. Each pair of bottom side panels, rear side panels, top side panels, and front side panels are integrally connected to the respective sides of each of the bottom, rear, top, and front
(Continued)

surface panels. The front receiving panel, the bottom and rear surface panels, and the bottom and rear side panels constitute a tray portion of the box, with the remaining panels constituting a lid portion of the box. A cut line for separating the lid portion from the tray portion is formed to pass through one or both of the rear surface panel and the top surface panel.

10 Claims, 17 Drawing Sheets

(30) Foreign Application Priority Data

| | | |
|---|---|---|
| Mar. 28, 2014 | (JP) | 2014-067527 |
| Jul. 14, 2014 | (JP) | 2014-144103 |
| Aug. 20, 2014 | (JP) | 2014-167321 |

(51) Int. Cl.

| | |
|---|---|
| ***B65B 5/02*** | (2006.01) |
| ***B65B 7/16*** | (2006.01) |
| ***B65D 5/16*** | (2006.01) |
| ***B65D 5/42*** | (2006.01) |
| ***B65D 5/64*** | (2006.01) |

(58) Field of Classification Search
USPC ..... 206/736, 738, 746, 774; 229/126, 164, 229/240, 241
See application file for complete search history.

(56) References Cited

U.S. PATENT DOCUMENTS

| | | | | |
|---|---|---|---|---|
| 4,553,666 | A | 11/1985 | Gullikson | |
| 5,036,981 | A | 8/1991 | Johansson | |
| 6,457,637 | B1 * | 10/2002 | Fritz | B65D 5/5445 206/736 |
| 6,755,306 | B2 * | 6/2004 | Maus | B65D 5/5405 206/774 |
| 2004/0163994 | A1 * | 8/2004 | Gardner | B65D 5/541 206/736 |
| 2004/0222127 | A1 * | 11/2004 | McLeod | B65D 5/4204 206/736 |
| 2005/0184139 | A1 * | 8/2005 | Gasior | B65D 5/0227 229/240 |
| 2009/0014352 | A1 | 1/2009 | Foden | |
| 2010/0276333 | A1 * | 11/2010 | Couture | B65D 5/5445 206/774 |
| 2013/0220876 | A1 | 8/2013 | Wintermute et al. | |

FOREIGN PATENT DOCUMENTS

| | | |
|---|---|---|
| CN | 202642263 | 1/2013 |
| EP | 2 103 536 | 9/2009 |
| JP | 50-009327 | 1/1975 |
| JP | 2-233353 | 9/1990 |
| JP | 2012-30892 | 2/2012 |
| JP | 2013-136395 | 7/2013 |
| WO | 2011/053493 | 5/2011 |

OTHER PUBLICATIONS

Written Opinion of the International Searching Authority in corresponding International Application No. PCT/JP2014/076005 (with English translation).
International Preliminary Report on Patentability in corresponding International Application No. PCT/JP2014/076005.
Extended European Search Report dated Oct. 20, 2016 in corresponding European Application No. 14855417.3.
First Office Action dated May 22, 2017 in corresponding Chinese Application No. 201480057234.8, with English translation.

* cited by examiner

Fig. 18- PRIOR ART
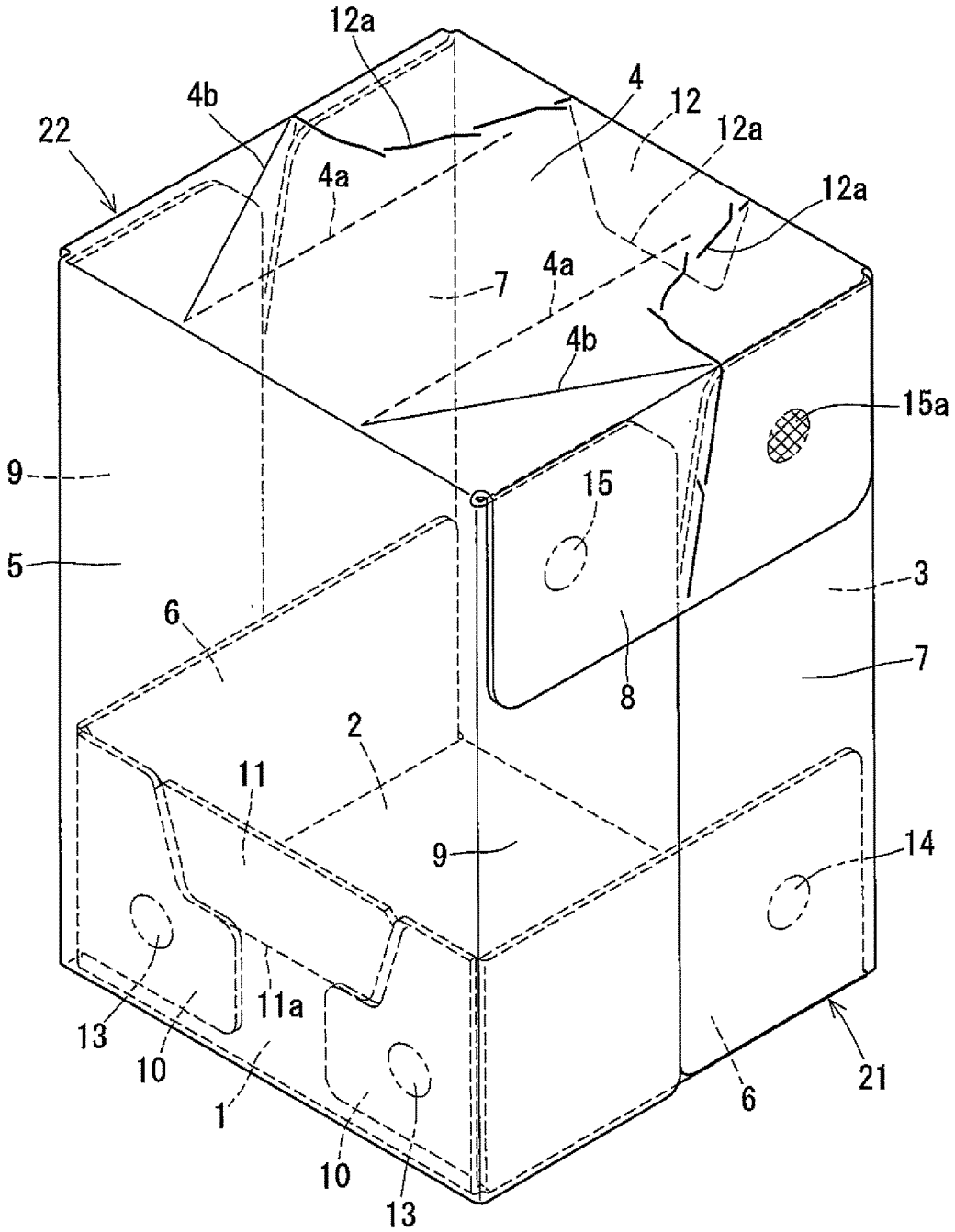

BOX FOR PACKING AND EXHIBITING PRODUCT, AND PACKING DEVICE THEREFOR

TECHNICAL FIELD

The present invention relates to a box for packing and exhibiting a product, and a packing device for the box.

BACKGROUND ART

As illustrated in FIG. 18, the below-identified Patent document 1 discloses a conventional box for packing and exhibiting a product, the box comprising a tray portion 51 on which products are received, and a lid portion 52 placed on the tray portion 51.

The tray portion 51 and the lid portion 52 of this box are assembled from separate blanks, respectively. The tray portion 51 includes a bottom wall 53, a front surface wall 54, a rear surface wall 55, a pair of side surface walls 60. The lid portion 52 includes a top surface wall 57, a front surface wall 58, a rear surface wall 59, and a pair of side surface walls 60. Perforated cut lines 61*a*, 62*a*, and 63*a* are formed in the front surface wall 54, the front surface wall 58, and the rear surface wall 55, respectively, such that separable portions 61, 62, and 63 are defined inside of the cut lines 61*a*, 62*a*, and 63*a*, respectively.

When products are packed in this box so as to deliver the products to a shop, the front surface walls 54, 58 are bonded together at respective bond portions 64 of the separable portions 61, 62, and the rear surface walls 55, 59 are bonded together at a bond portion 65 of the separable portion 63, so that the tray portion 51 and the lid portion 52 are fixed to each other and the box is kept sealed.

When products are exhibited at a shop while received in the box, the box is severed along the cut lines 61*a*, 62*a* such that the separable portions 61, 62 are separated from the front surface walls 54, 58, respectively, while bonded together, and by turning the lid portion 52 about the bottom end edge of the rear surface wall 59, the separable portion 63 is separated from the rear surface wall 55 while bonded to the rear surface wall 59 due to the severance of the box along the cut line 63*a*.

By opening the box in this way, the lid portion 52 is separated from the tray portion 51. Therefore, by removing the lid portion 52 from the tray portion 51, products can be visibly exhibited while received in the tray portion 51 such that customers can easily see the products.

PRIOR ART DOCUMENT(S)

Patent Document(s)

Patent document 1: Japanese Unexamined Patent Application Publication No. 2012-30892

SUMMARY OF THE INVENTION

Problems to be Solved by the Invention

However, in such a box for packing and exhibiting a product as described above, when the box is opened at a shop so as to exhibit products in the box, since two steps are necessary, specifically, it is necessary to separate the separable portions 61, 62 of the rear surface walls 54, 58 and further to separate the separable portion 63 of the rear surface wall 55, it takes time.

Also, since the portions of the tray portion 51 and the lid portion 52 overlapping with each other are large, the amount of material necessary for forming the box increases, and thus manufacturing costs are high.

It is an object of the present invention to provide a box for packing and exhibiting a product which can be easily opened so as to exhibit products in the box and for which the amount of material can be reduced, and a packing device for the box.

Means for Solving the Problems

In order to achieve the above object, the present invention provides a box for packing and exhibiting a product, the box comprising a tray portion and a lid portion, wherein the tray portion comprises: a front receiving panel; a bottom surface panel; a rear surface panel; bottom side panels integrally connected to respective sides of the bottom surface panel; and rear side panels integrally connected to respective sides of the rear surface panel; wherein the lid portion comprises: a top surface panel; a front surface panel; top side panels integrally connected to respective sides of the top surface panel; and front side panels integrally connected to respective sides of the front surface panel, wherein the front receiving panel, the bottom surface panel, the rear surface panel, the top surface panel, and the front surface panel are each integrally connected to another of the front receiving panel, the bottom surface panel, the rear surface panel, the top surface panel, and the front surface panel, and configured to cover a product, wherein a first cut line for separating the lid portion from the tray portion is formed so as to pass through only an area of the rear surface panel, only an area of the top surface panel, or areas of both the rear surface panel and the top surface panel.

The box is configured such that with a product packed in the box, the front receiving panel and the rear surface panel are bent to stand relative to the bottom surface panel, the top surface panel is bent forward relative to the rear surface panel, the front surface panel is bent downwardly relative to the top surface panel so as to be superposed on the front receiving panel, the bottom side panels bent relative to the bottom surface panel and the rear side panels bent relative to the rear surface panel are bonded together, and the front side panels bent relative to the front surface panel and the top side panels bent relative to the top surface panel are bonded together such that respective side surfaces of the box are formed, and wherein the box is further configured such that when a product is exhibited in the box, the box is severed along the first cut line, and the lid portion is separated from the tray portion.

The present invention also provides a box for packing and exhibiting a product according to various embodiments, the box having such a basic structure as described above, and a packing device for automatically assembling the box.

Effects of the Invention

In the box for packing and exhibiting a product according to the present invention, the tray portion and the lid portion are constituted by a one-piece blank, and a cut line is formed so as to separate the lid portion from the tray portion. Therefore, it is possible to open the box by simply pulling the lid portion and severing the lid portion along the cut line, and to exhibit products in the box.

Since the tray and lid portions overlap with each other only at a portion of the front surface of the box and portions of the respective side surfaces of the box, it is possible to reduce the amount of material necessary for forming the box. Moreover, since the box has a simple packing structure, the box is suitable for a packing device such as a sealing machine, and can be efficiently sealed. It is also possible to easily assemble the box by hand.

Moreover, since products can be packed in the box while assembling the box by a packing device, it is possible to pack products accurately and promptly, and to efficiently deliver the box.

Moreover, products can be exhibited beautifully in the tray portion since the cut edges of the tray portion are not noticeable, the front receiving panel of the tray portion can prevent products from moving out of the tray portion, and the rear surface panel supports products such that the products can be exhibited while kept stable.

BRIEF DESCRIPTION OF THE DRAWINGS

FIG. 8(I) to 8(VI) are schematic perspective views illustrating the upstream process of a packing device according to the present invention.

FIG. 9(I) to 9(VII) are schematic perspective views illustrating the intermediate process of the packing device.

FIG. 10(I) to 10(VI) are schematic perspective views illustrating the downstream process of the packing device.

FIG. 18 is a perspective view illustrating the state in which products are packed in a conventional box for packing and exhibiting a product.

BEST MODE FOR CARRYING OUT THE INVENTION

The box for packing and exhibiting a product according to the first embodiment of the present invention is now described with reference to FIGS. 1 to 5.

Figure 1:
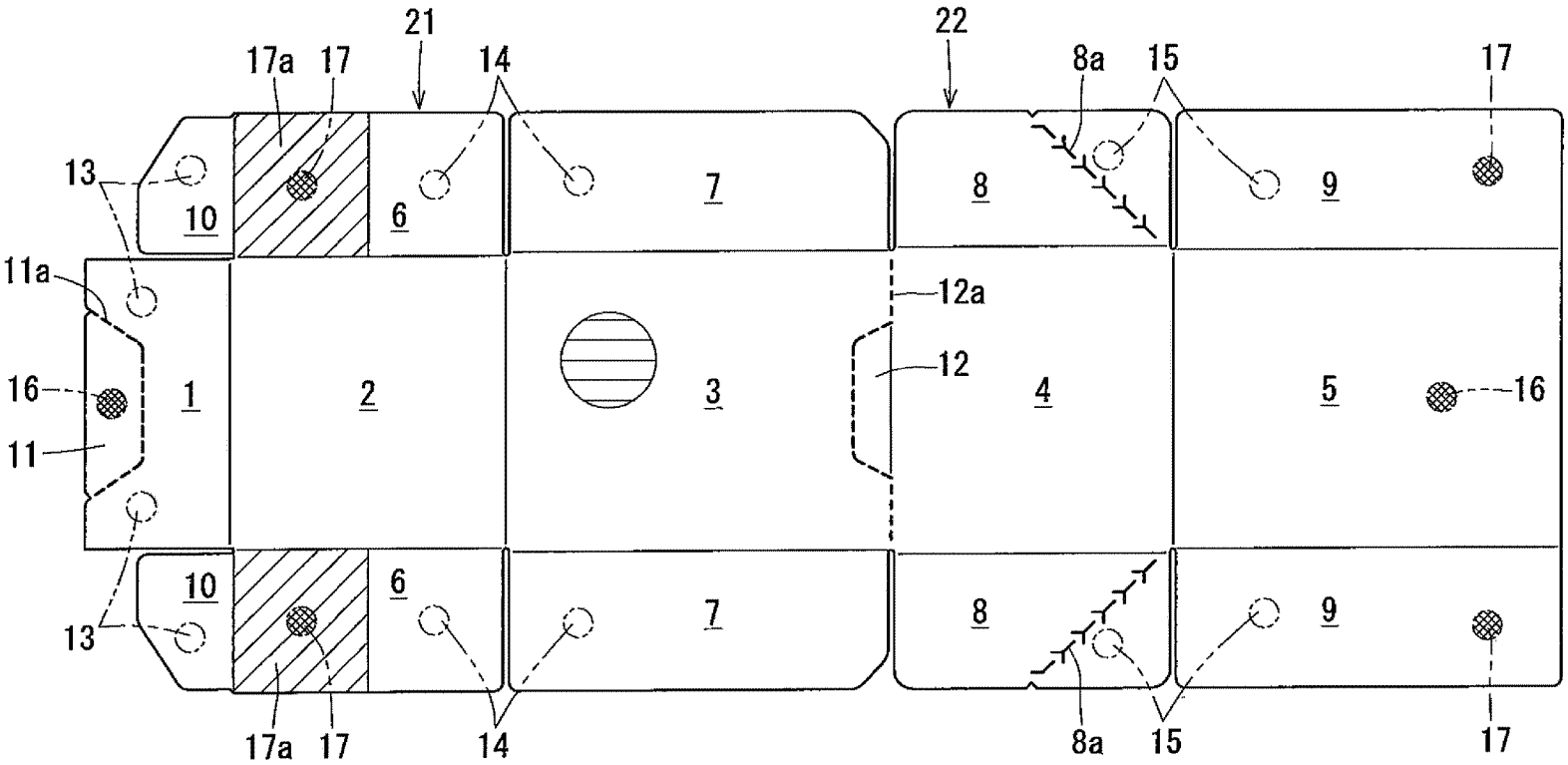
FIG. 1 is a view illustrating the blank of a box for packing and exhibiting a product according to a first embodiment of the present invention.

The box of the first embodiment has a height larger than its depth, and is to be assembled from the blank of corrugated paperboard illustrated in FIG. 1. This blank includes a front receiving panel 1, a bottom surface panel 2, a rear surface panel 3, a top surface panel 4, and a front surface panel 5 that are integrally connected one to another in the direction of the corrugations of the corrugated paperboard. The blank further includes bottom side panels 6 integrally connected to the respective sides of the bottom surface panel 2, rear side panels 7 integrally connected to the respective sides of the rear surface panel 3, top side panels 8 integrally connected to the respective sides of the top surface panel 4, front side panels 9 integrally connected to the respective sides of the front surface panel 5, and coupling pieces 10 coupled to the ends of the respective bottom side panels 6 on the side of the front receiving panel 1.

The front receiving panel 1 is formed with a perforated cut line 11*a* extending from the distal end of the front receiving panel 1 to define a separable portion 11 having an inverted trapezoidal shape inside of the cut line 11*a*. At the boundary between the rear surface panel 3 and the top surface panel 4, a perforated cut line 12*a* extends from one end of the boundary to the other end, while being bent, at the intermediate portion of the cut line 12*a*, into the rear surface panel 3 such that a push-in portion 12 having an inverted trapezoidal shape is defined inside of the bent intermediate portion of the cut line 12*a*.

The top side panels 8 are each formed with a scoreline 8*a* extending obliquely from the corner of the top side panel 8 connecting to the boundary between the top surface panel 4 and the front surface panel 5 to the middle portion of the distal edge of the panel 8. The scoreline 8*a* is constituted by discontinuous Y-shaped cuts such that the top side panel 8 can be easily bent in a reverse direction (which is an opposite direction to a normal direction) on the outer surface of the top side panel 8 along the scoreline 8*a*. Alternatively, the scoreline 8*a* may be in the form of a "lead ruled line" constituted by press rules and cuts formed such that the press rules alternate with the cuts.

The front receiving panel 1, the bottom surface panel 2, the rear surface panel 3, the bottom side panels 6, the rear side panels 7, and the coupling pieces 10 of the blank constitute a tray portion 21, while the top surface panel 4, the front surface panel 5, the top side panels 8, and the front side panels 9 of the blank constitute a lid portion 22.

When the tray portion 21 is assembled, bond portions 13 of the front receiving panel 1 are bonded to bond portions 13 of the respective coupling pieces 10 by means of hot-melt adhesive, and bond portions 14 of the bottom side panels 6 at their rear portions are bonded to bond portions 14 of the respective rear side panels 7 at their lower portions by means of hot-melt adhesive. When the lid portion 22 is assembled, bond portions 15 of the top side panels 8 at their front portions, namely, portions located forward of the respective scorelines 8*a* are bonded to bond portions 15 of the front side panels 9 at their upper portions by means of hot-melt adhesive.

The tray portion 21 and the lid portion 22 are joined together by bonding a bond portion 16 (netted portion in the drawings) of the separable portion 11 of the front receiving panel 1 to a bond portion 16 (netted portion in the drawings) of the front surface panel 5 at its lower portion.

If heavy products are packed in the box, in order to more firmly join the tray and lid portions 21 and 22 together without making it difficult to open the box, varnish is entirely applied to the front portions of the respective bottom side panels 6 such that the vanish-applied front portions are defined as bond weakening portions 17*a* (portions of the respective panels 6 having oblique lines in the drawings), and netted portions denoted as bond portions 17 on the respective bond weakening portions 17*a* and netted portions denoted as bond portions 17 at the lower portions of the front side panels 9 are bonded together by means of hot-melt adhesive.

Figure 2:
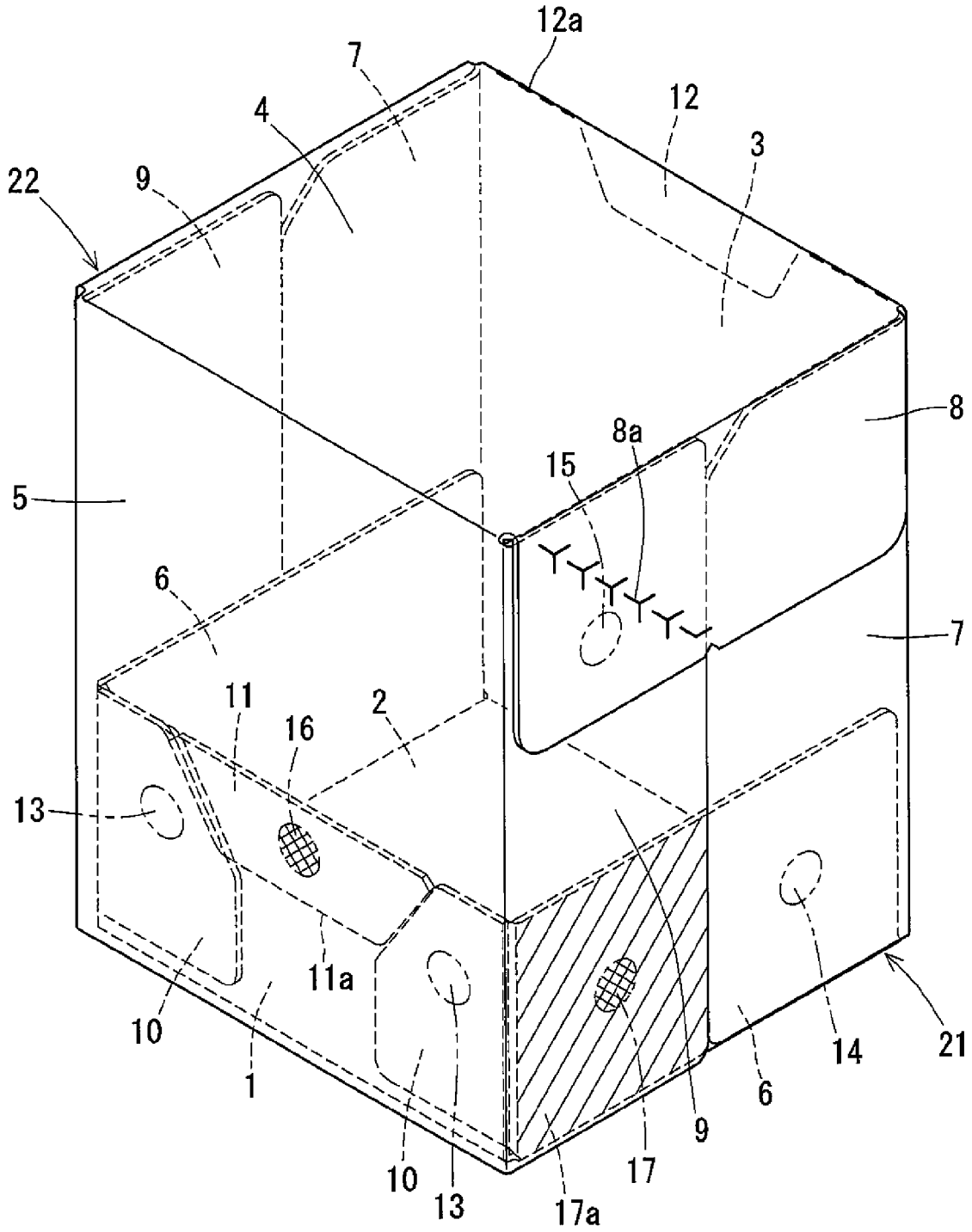
FIG. 2 is a perspective view illustrating the state in which products are packed in the box according to the first embodiment.

When such a blank is assembled into the box illustrated in FIG. 2 so as to pack products in the box, for example, the front receiving panel 1, the bottom side panels 6, and the rear surface panel 3 are bent to stand relative to the bottom surface panel 2, the coupling pieces 10 are bent to extend along the inner surface of the front receiving panel 1, and the coupling pieces 10 and the front receiving panel 1 are bonded together at the respective bond portions 13, so that the front receiving panel 1 and the bottom side panels 6 are coupled together. Thereafter, the rear side panels 7 are bent forward such that the rear side panels 7 and the bottom side panels 6 are bonded together at the respective bond portions 14.

Thereafter, products are placed in the box, the top surface panel 4 is bent forward relative to the rear side panel 3, the front surface panel 5 is bent downwardly relative to the top surface panel 4, the front side panels 9 are bent rearward relative to the front surface panel 5, and the top side panels 8 are bent downwardly relative to the top surface panel 4. At this time, though the top side panels 8 and the front side panels 9 are bonded together at the respective bond portions 15 such that the top side panels 8 are kept bent, the top side panels 8 are not bonded to the respective rear side panels 7. Thereafter, the front receiving panel 1 and the portion of the front surface panel 5 overlapping with the front receiving panel 1 are bonded together at the respective bond portions 16, thereby sealing the box.

If heavy products are packed in the box, as necessary, the front side panels 9 and the bottom side panels 6 are bonded together at the bond portions 17 through the respective bond weakening portions 17*a*.

Figure 3:
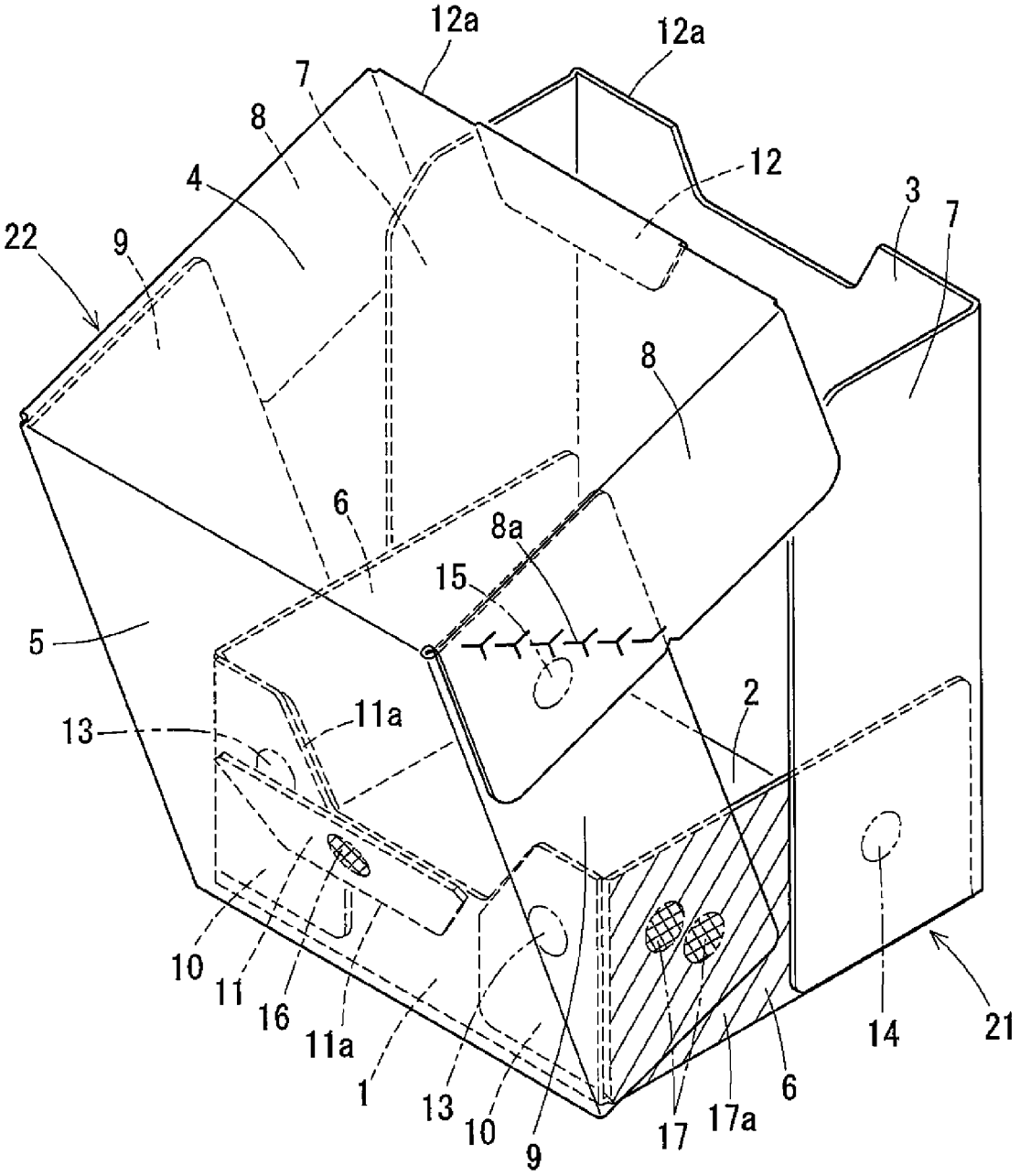
FIG. 3 is a perspective view illustrating the intermediate stage from the products-packed state to the products-exhibited state of the box according to the first embodiment.

In order to exhibit the products in the box at a shop, the box is opened by separating the lid portion 22 from the tray portion 21. For this purpose, as illustrated in FIG. 3, a user inserts his/her fingers into the box by pushing in the push-in portion 12 of the rear surface panel 3 at its upper portion, and pulls the rear portion of the top surface panel 4 forward such that the box is severed along the cut line 12*a*, and the separable portion 11 is severed from the front receiving panel 1 along the cut line 11*a*, while being bonded to the front surface panel 5. The lid portion 22 is thus separated from the tray portion 21, and the box is opened.

At this time, since the adhesive force of the hot-melt adhesive applied to the bond portions 17 is weakened due to the action of the bond weakening portions 17*a*, to which varnish is applied, it is possible to easily separate the lid portion 22 from the tray portion 21.

Figure 4:
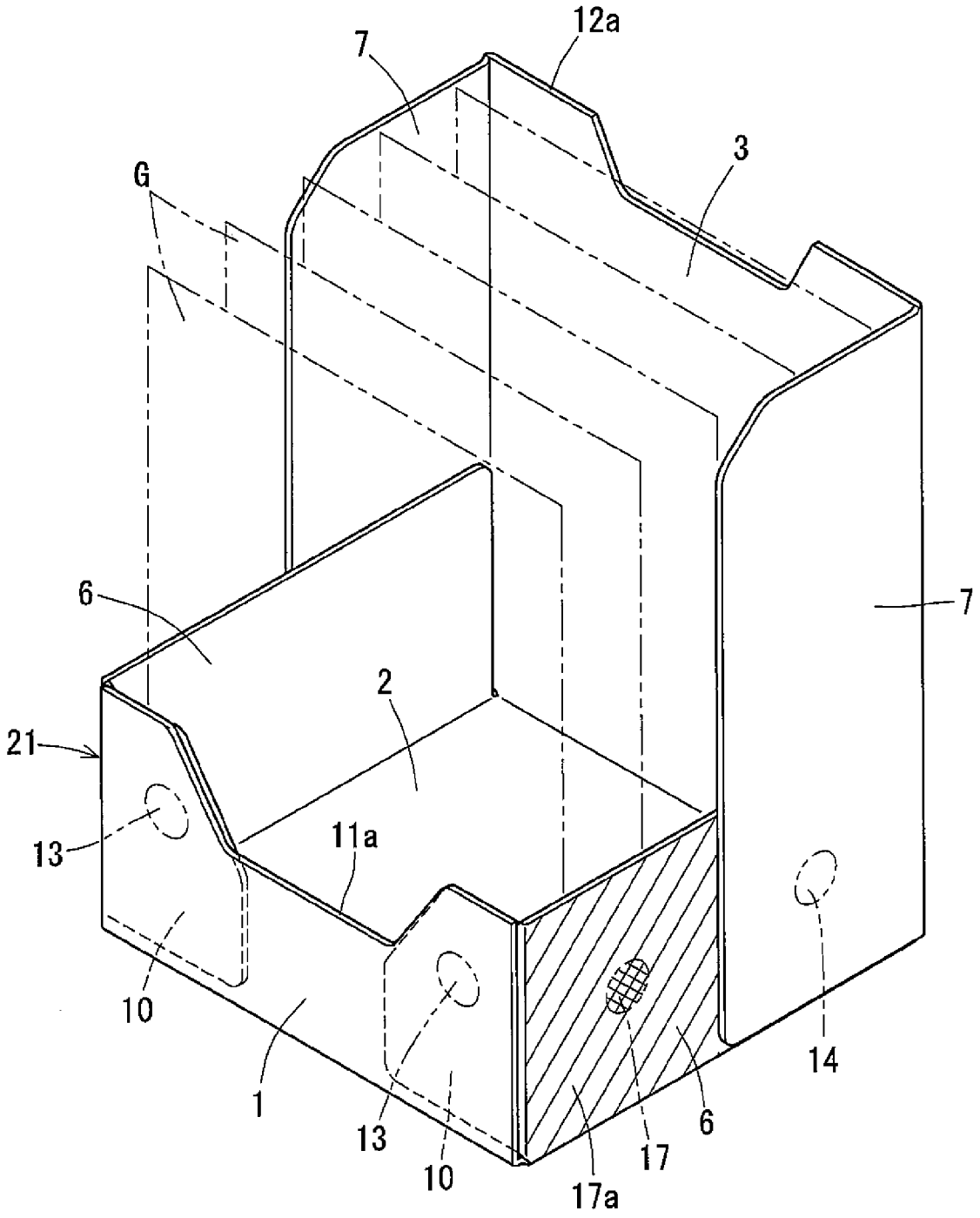
FIG. 4 is a perspective view illustrating the state in which products are exhibited in the tray portion of the box according to the first embodiment.

Thereafter, as illustrated FIG. 4, the lid portion 22 is removed from the tray portion 21 so that the products G received in the tray portion 21 are visibly exhibited. In this exhibition state, the tray portion 21 is excellent in appearance since the cut edges of the tray portion 21 are not noticeable; the front receiving panel 1 can prevent the products G from moving out of the tray portion 21; and the products G lean against the rear surface panel 3 such that the products G can be exhibited while kept stable.

Figure 5:
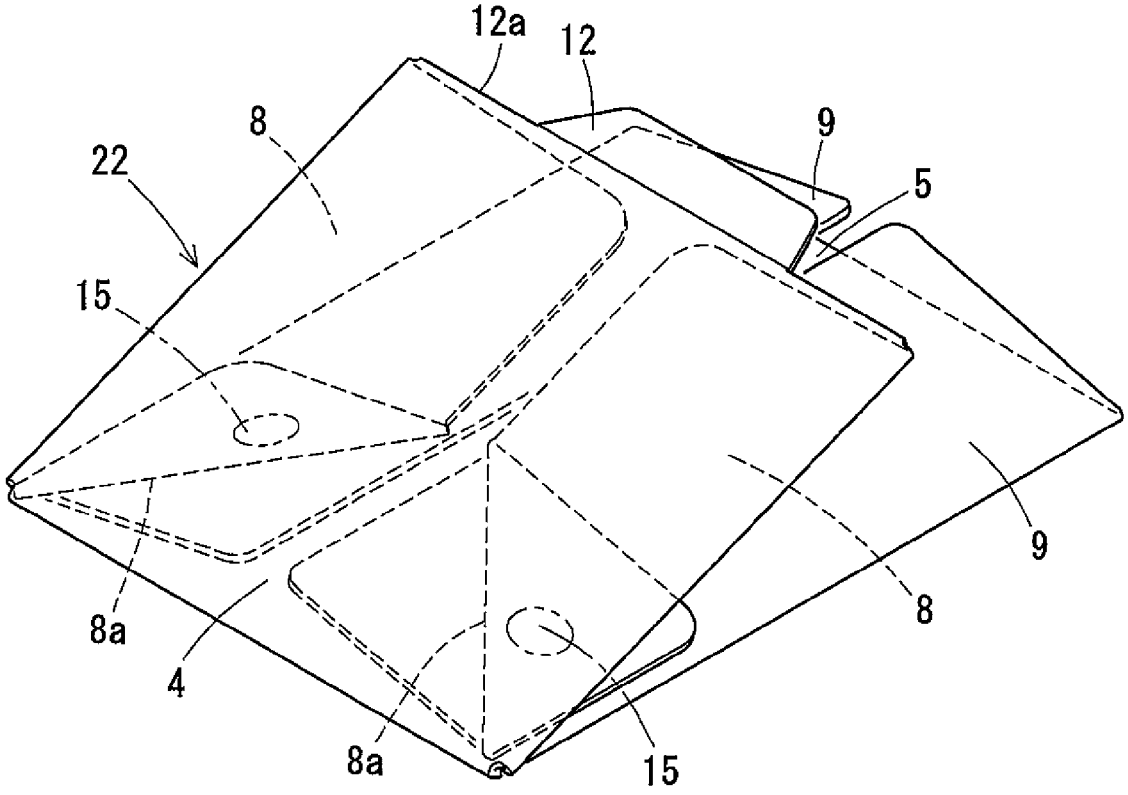
FIG. 5 is a perspective view illustrating the state in which the lid portion of the box according to the first embodiment is folded.

Moreover, as illustrated in FIG. 5, once the lid portion 22 is separated from the tray portion 21, the lid portion 22 can be folded flat by folding the top side panels 8 along the respective scoreline 8*a*. Therefore, the lid portion 22 can be discarded as recyclable garbage while compactly folded.

As described above, in the above box for packing and exhibiting a product, since the tray portion 21 and the lid portion 22 are constituted by a one-piece blank, and when products are packed in the box, the lid portion 22 is fixed to the tray portion 21 only by basically bonding the front surface panel 5 and the separable portion 11 of the front side panel 1 together at the respective bond portions 16, the separable portion 11 can be separated only by severing the box along the cut line 12*a*, which extends to the respective ends of the boundary between the rear surface panel 3 and the top surface panel 4, and by pulling the lid portion 22 forward, thereby opening the box.

Since the tray and lid portions 21, 22 overlap with each other only at a portion of the front surface of the box and portions of the respective side surfaces of the box, it is possible to reduce the amount of material necessary for forming the box. Moreover, since the box has a simple packing structure, the box is suitable for a packing device such as a sealing machine, and can be efficiently sealed.

The box may also be configured such that the intermediate portion of the cut line 12*a* is bent into the top surface panel 4 such that the push-in portion 12 is formed inside of the bent intermediate portion of the cut line 12*a*, and when exhibiting the products in the box at a shop, a user severs the box along the cut line 12*a* by inserting his/her fingers into the box while pushing in the push-in portion 12 of the top surface panel 4, and by pulling the top surface panel 4 forward. The cut line 12*a* may pass only through an area of the rear surface panel 3, only through an area of the top surface panel 4, or through areas of both the rear surface panel 3 and the top surface panel 4.

The box for packing and exhibiting a product according to the second embodiment of the present invention is now described with reference to FIGS. 6 and 7.

Figure 6:
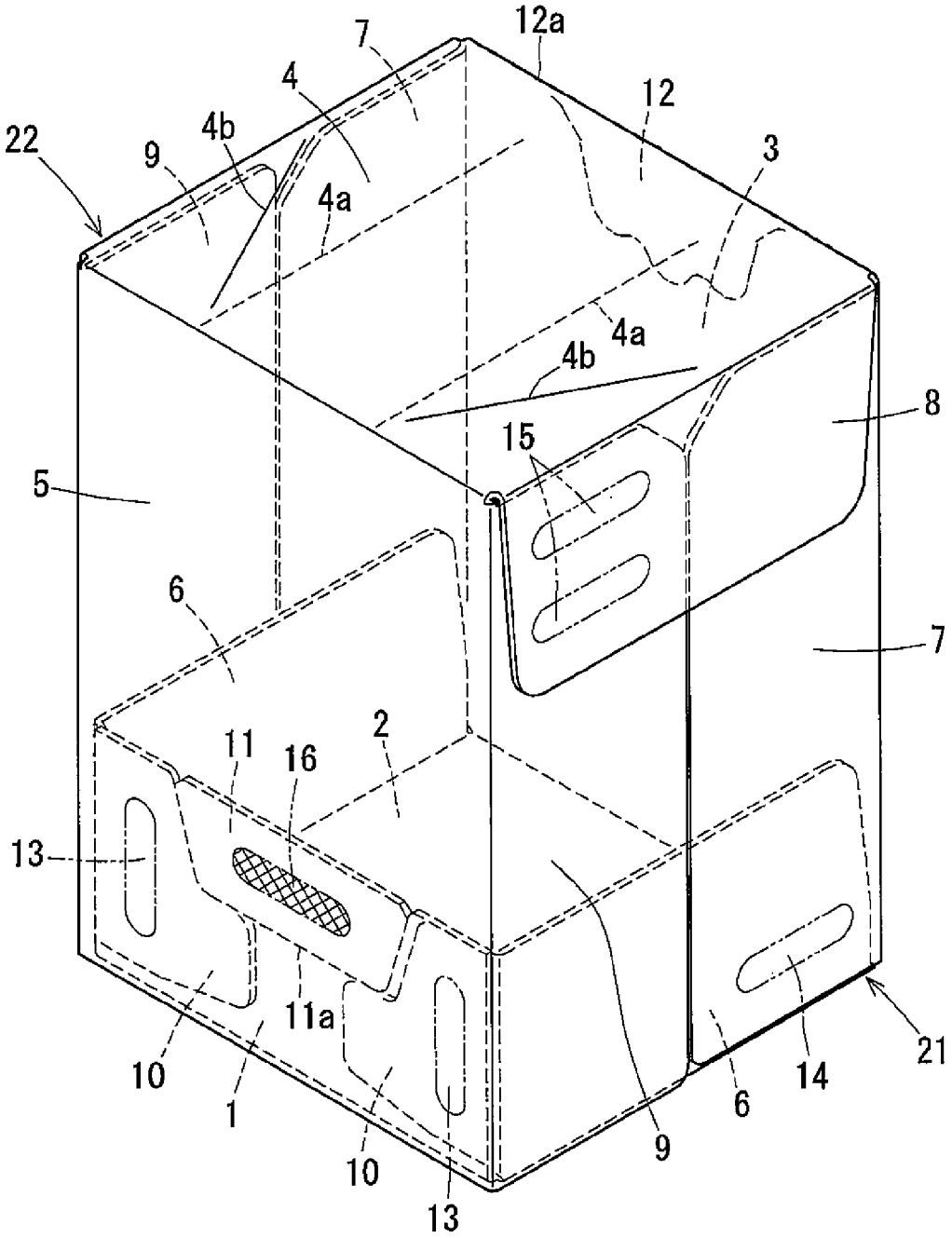
FIG. 6 is a perspective view illustrating the state in which products are packed in a box for packing and exhibiting a product according to a second embodiment of the present invention.

In the box of the second embodiment, as illustrated in FIG. 6, the top surface panel 4 is formed with two normal scorelines 4*a* extending from the vicinities of the respective end portions of a push-in portion 12 to the front portion of the top surface panel 4, and two reverse scorelines 4*b* extending obliquely toward the front portions of the respective normal scorelines 4*a* from the middle portions of the respective sides of the top surface panel 4 in the forward and rearward direction of the box.

Figure 7:
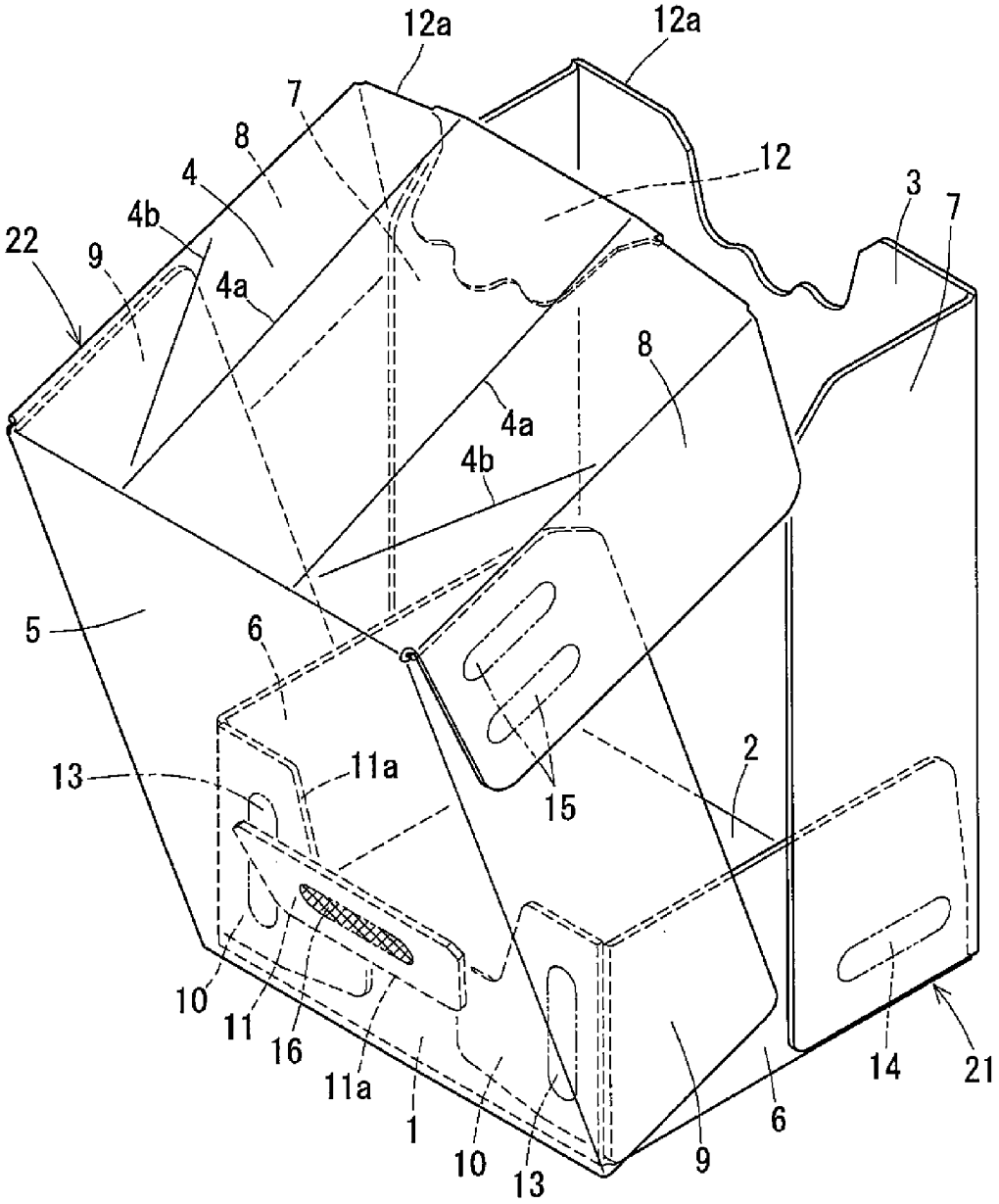
FIG. 7 is a perspective view illustrating the intermediate stage from the products-packed state to the products-exhibited state of the box according to the second embodiment.

By forming the normal scorelines 4*a* and the reverse scorelines 4*b*, since the top surface panel 4 bends so as to bulge along the normal scorelines 4*a* and the reverse scorelines 4*b* when the push-in portion 12 is pushed in and the top surface panel 4 is pulled up as illustrated in FIG. 7 so as to exhibit products in the box, a large pulling force acts on the joint portions of a cut line 12*a*, thereby making it possible to easily sever box along the cut line 12*a* and open the box.

Figure 8:
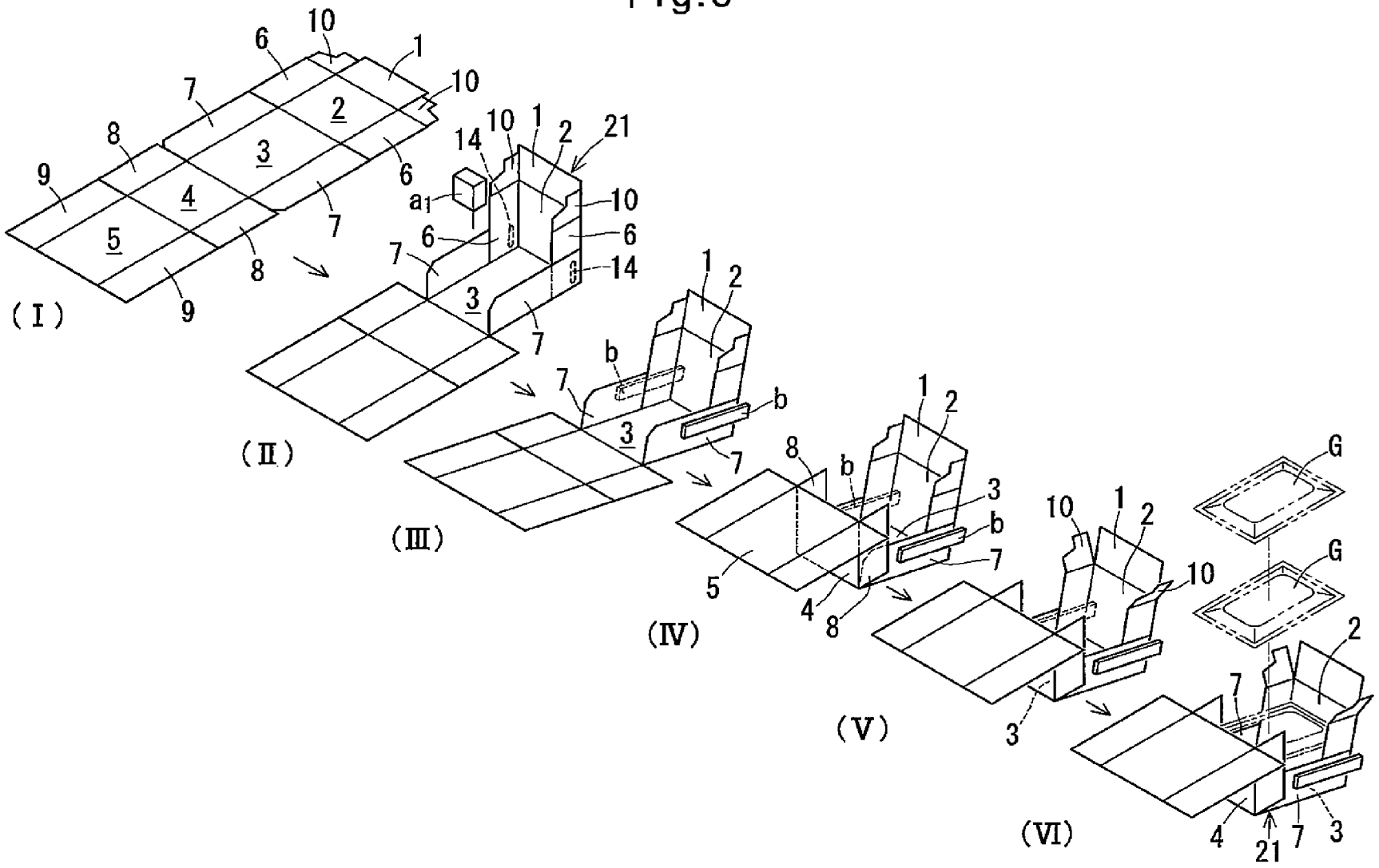

Now referring to FIGS. 8(I) to 8(VI), 9(I) to 9(VII), and 10(I) to 10(VI), a packing device is outlined for storing and packing food pouches in such a box for packing and exhibiting a product having a height larger than its depth as described in the first and second embodiments.

In this packing device, as illustrated in FIG. 8(I), the blank of the box for packing and exhibiting a product is supplied from a magazine with the outer surface of the blank directed downwardly. Thereafter, as illustrated in FIG. 8(II), the bottom surface panel 2 is bent to stand relative to the rear surface panel 3; the bottom side panels 6 are bent relative to the bottom surface panel 2; hot-melt adhesive is sprayed onto the bond portions 14 of the respective bottom side panels 6 from an adhesive nozzle $a_1$; and the rear side panels 7 are bent to be firmly bonded to the respective bottom side panels 6, so that part of the assembling of the tray portion 21 is completed.

Thereafter, as illustrated in FIG. 8(III), the rear side panel 3 is tilted such that the closer the panel 3 is located to the bottom surface panel 2, the lower level the panel 3 is located at, and with the rear side panels 7 held by respective holding tools b, the blank is conveyed to subsequent steps. Thereafter, as illustrated in FIG. 8(IV), the top surface panel 4 is bent to a position where it does not yet completely stand relative to the rear surface panel 3; the front surface panel 5 is bent away from the bottom surface panel 2; and the top side panels 8 are temporarily bent relative to the top surface panel 4 so as to overlap with the respective rear side panels 7. By temporarily bending the top side panels 8 to this position, the top side panels 8 can be easily bent in this direction at a later stage, and also allow the rear side panels 7 to stably stand relative to the rear surface panel 3.

Thereafter, the coupling pieces 10 are slightly bent outwardly as illustrated in FIG. 8(V), and as illustrated in FIG. 8(VI), products G comprising food pouches are successively dropped onto the inner surface of the rear surface panel 3 by a manipulator, etc. with the flat surfaces of each product G directed upwardly and downwardly, respectively, so as to pile up in the tray portion 21.

At this time, since the top surface panel 4 is tilted such that the upper portion of the panel 4 is further away from the bottom surface panel 2, and the coupling pieces 10 are slightly bent outwardly, the top surface panel 4 and the coupling pieces 10 never interfere with the insertion of the products G into the tray portion 21, so that the products G are smoothly guided into the box, while sliding along the rear surface panel 3, which is tilted, toward the bottom surface panel 2, and are stored in the tray portion 21 while being restrained and neatly arranged by the rear side panels 7 and the top surface panel 4.

Figure 9:
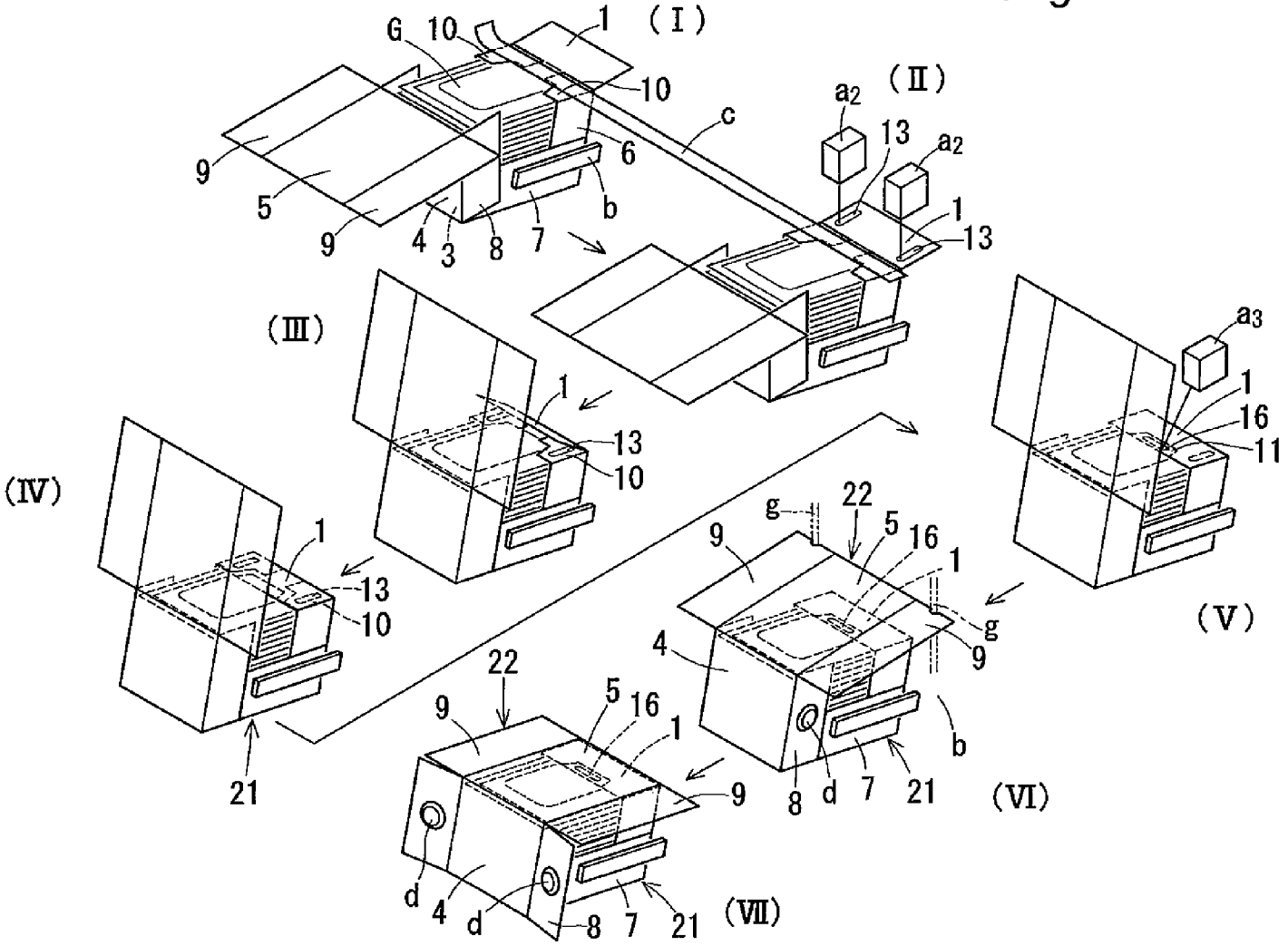

Thereafter, as illustrated in FIG. 9(I), the coupling pieces 10 are bent inwardly, and the front receiving panel 1 is bent outwardly with the coupling pieces 10 pressed by a pressing bar c so as to be kept bent inwardly. In this state, as illustrated in FIG. 9(II), hot-melt adhesive is sprayed onto the bond portions 13 of the inner surface of the front receiving panel 1 from respective adhesive nozzles $a_2$. Thereafter, the pressing of the coupling pieces 10 by the pressing bar c is released, and the front receiving panel 1 is bent as illustrated in FIG. 9(III), and pressed against and firmly bonded to the coupling pieces 10 as illustrated in FIG. 9(IV), so that the assembling of the tray portion 21 is completed.

Thereafter, hot-melt adhesive is sprayed onto the bond portion 16 of the separable portion 11 of the front receiving panel 1 from an adhesive nozzle $a_3$ as illustrated in FIG. 9(V), the front surface panel 5 is bent toward the front receiving panel 1 as illustrated in FIG. 9(VI), and as illustrated in FIG. 9(VII), the lid portion 22 is placed on the tray portion 21 such that the front surface panel 5 is pressed against and firmly bonded to the separable portion 11. Also at this time, due to the suction of suckers d, the top side panels 8 are temporarily separated from the respective rear side panels 7. The reason why the top side panels 8 are temporarily separated is because by doing so, the top side panels 8 can be superposed on the outer sides of the respective front side panels 9 (in a subsequent step), so that the rear side panels 7 and the front side panels 9 can support the top side panel 4 such that the panel 4 never falls in the delivery process of the box to a shop.

When the front surface panel 5 and the separable portion 11 are bonded together at the respective bond portions 16, in order to prevent the displacement of the front surface panel 5 in the width direction relative to the front receiving panel 1, as illustrated in FIG. 9(VI), by forming cutouts in the end edges of the respective front side panels 9 on the side of the front receiving panel 1, the front surface panel 5 may be bent with vertically extending guide bars g engaged in the respective cutouts.

Figure 10:
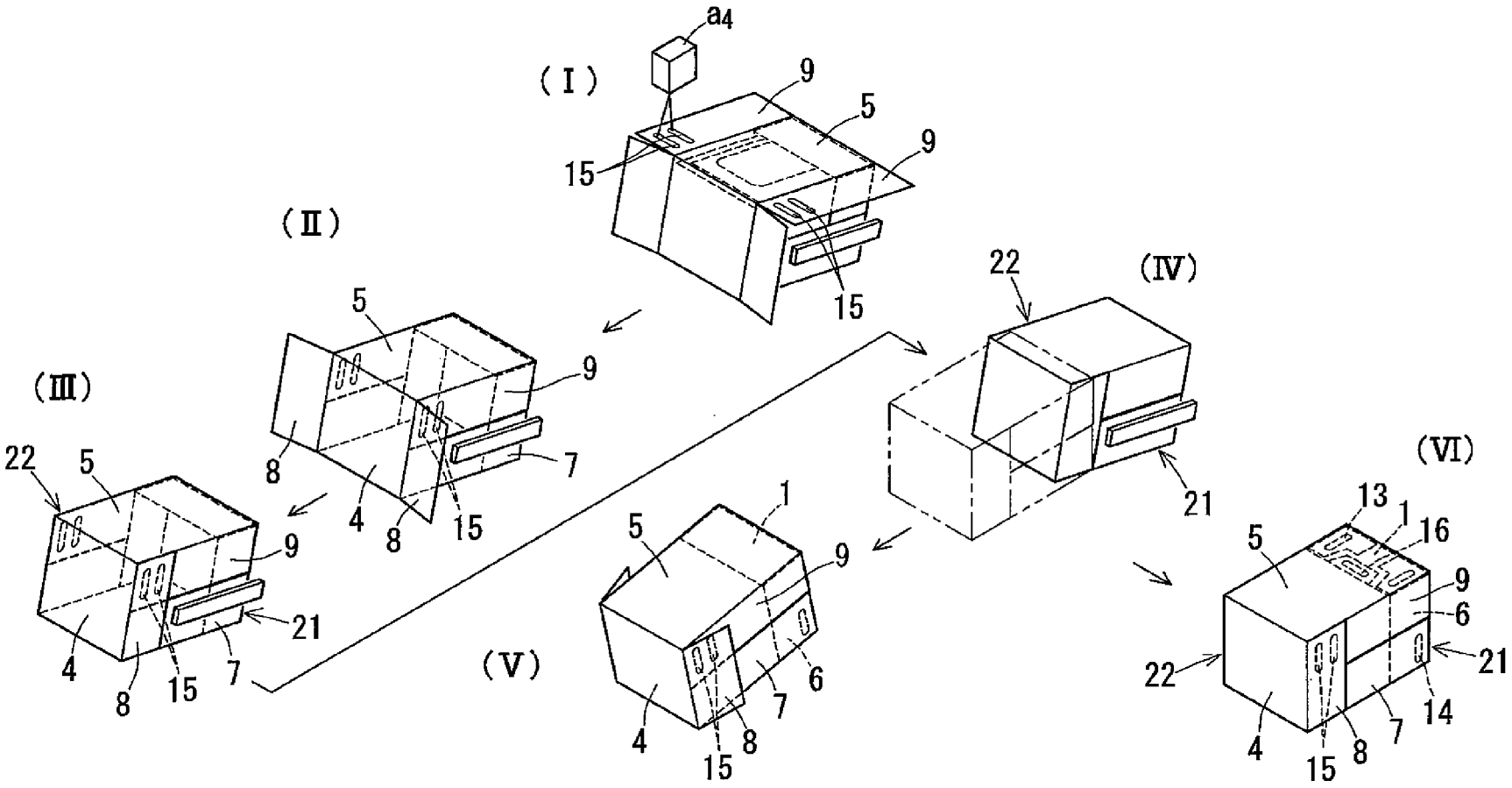

Thereafter, hot-melt adhesive is sprayed onto the bond portions 15 of the respective front side panels 9 from an adhesive nozzle $a_4$ as illustrated in FIG. 10(I), and the front side panels 9 are bent such that the distal edges of the front side panels 9 abut the distal edges of the respective rear side panels 7 as illustrated in FIG. 10(II). Thereafter, as illustrated in FIG. 10 (III), the top side panels 8 are bent so as to be superposed on the outer surfaces of the respective rear side panel 7 and the outer surfaces of the respective front side panels 9, the top side panels 8 are pressed against and firmly bonded to the respective front side panels 9, and the lid portion 22 is fixed to the tray portion 21. As a result thereof, the assembling of the box is completed as illustrated in FIG. 10(IV).

As for the box for packing and exhibiting a product assembled in this way, if, as illustrated in FIG. 10 (V), one or both of the top side panels 8 are separated from the respective rear side panels 7 due to insufficient bonding, the box is pushed by a pusher out of the assembly line, and if the top side panels 8 are firmly bonded to the respective rear side panels 7, as illustrated in FIG. 10(VI), the box is conveyed by a conveyor to the delivery end of the line for non-deficient boxes, and then is shipped.

By use of such a packing device as described above so as to pack products G such as food pouches in the box for packing and exhibiting a product, it is possible to pack products G accurately and quickly, and to store the piled up products G in the box with little gaps left therebetween, in other words, it is possible to effectively pack products G in the box, and to ship the box. Also, it is possible to prevent the products G from moving out of the tray portion 21 with the products G exhibited in the tray portion 21, right after the lid portion 22 is separated from the tray portion 21, and thus to beautifully exhibit the products G in the tray portion 21.

Figure 11:
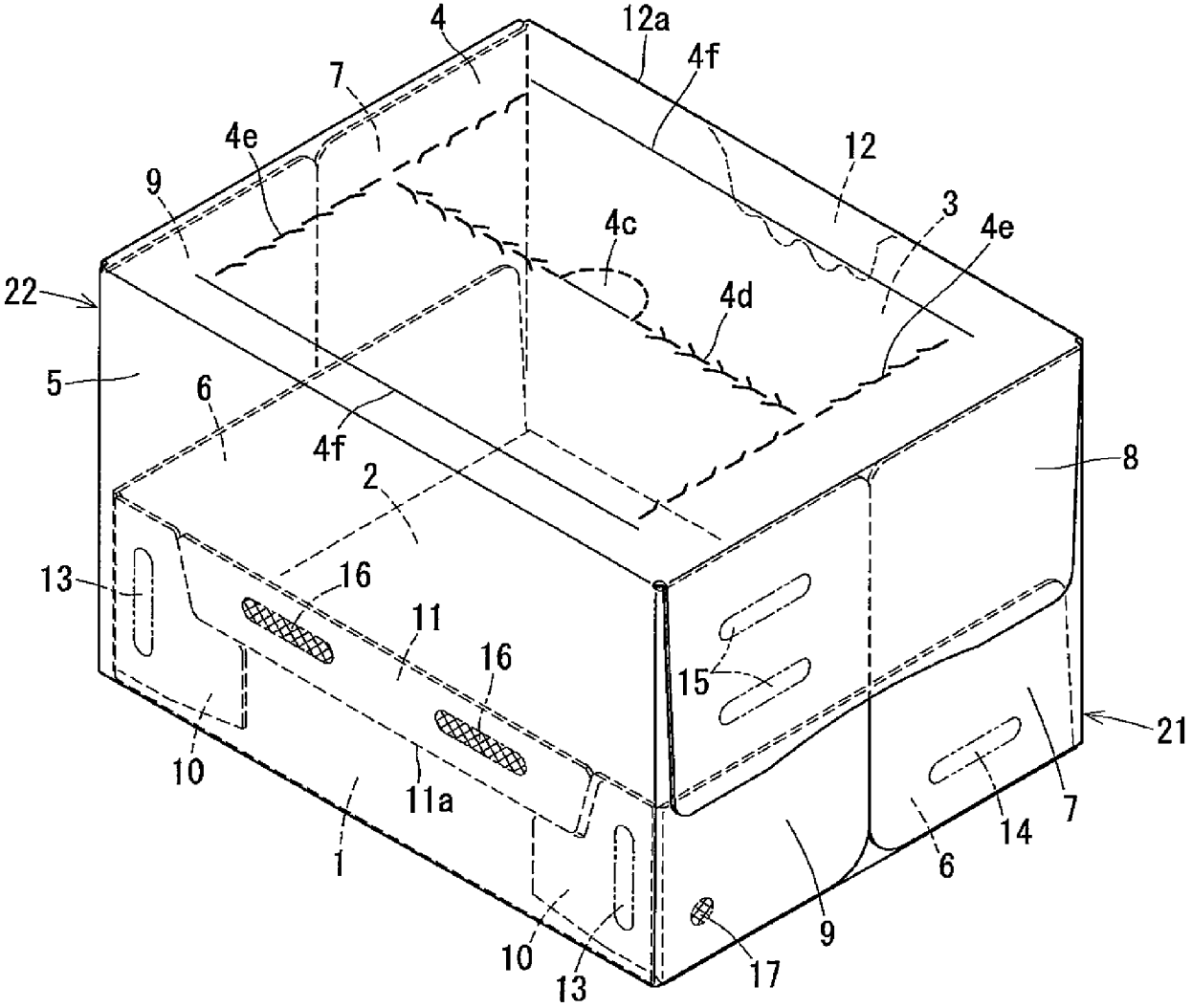
FIG. 11 is a perspective view illustrating the state in which products are packed in a box for packing and exhibiting a product according to a third embodiment of the present invention.

The box for packing and exhibiting a product according to the third embodiment of the present invention is now described with reference to FIGS. 11 to 13.

The box of the third embodiment is used for storing a plurality of drink bottles with the bottles closely packed together in upright position. In this box, as illustrated in FIG. 11, the top surface panel 4 has a push-in portion 4*c* formed at the middle portion of the top surface panel 4 by a semicircular arc-shaped cut line, cut lines 4*d* extending from the push-in portion 4*c* toward the respective sides of the top surface panel 4, cut lines 4*e* extending from the outer ends of the respective cut lines 4*d* toward the front and rear portions of the top surface panel 4, and reverse scorelines 4*f* extending between the terminal ends of one of the cut lines 4*e* and the respective terminal ends of the other of the cut lines 4*e*, and formed by pressing the outer surface of the corrugated paperboard. By bending the terminal ends of the cut lines 4*e*, it is possible to prevent the top surface panel 4 from being severed beyond the positions of the respective reverse scorelines 4*f* when severing the top surface panel 4 along the cut lines 4*e*.

Figure 12:
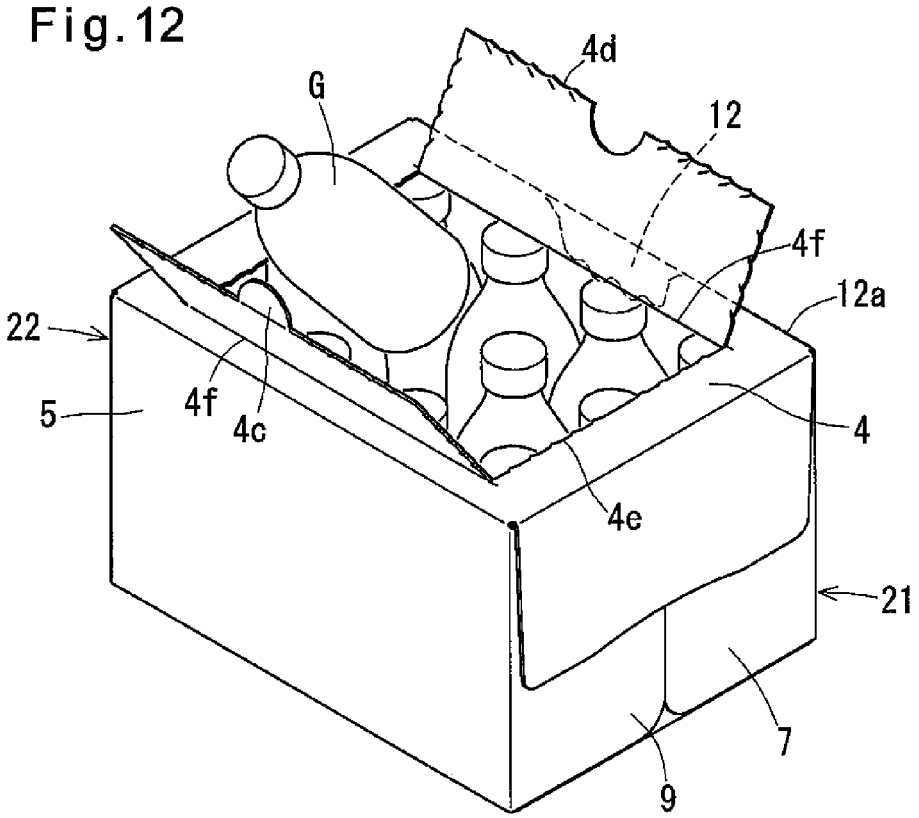
FIG. 12 is a perspective view illustrating the state in which only the top surface of the box according to the third embodiment is open.

When products G comprising drink bottles are taken out of such a box for packing and exhibiting a product, as illustrated in FIG. 12, the top surface panel is severed along the cut lines 4*d* and 4*e* by pushing in the push-in portion 4*c* and pulling up the portion of the top surface panel 4 surrounding the push-in portion 4*c*, and the door portions of the top surface panel 4 defined by the cut lines 4*d* and 4*e*, and the reverse scorelines 4*f* are opened by pivoting the door portions about the respective reverse scorelines 4*f*, so that it is possible to take the required number of products G out of the box with only the top surface panel 4 open. Also, after taking the required number of products G out of the box, it is possible to keep the door portions of the top surface panel 4 closed.

Figure 13:
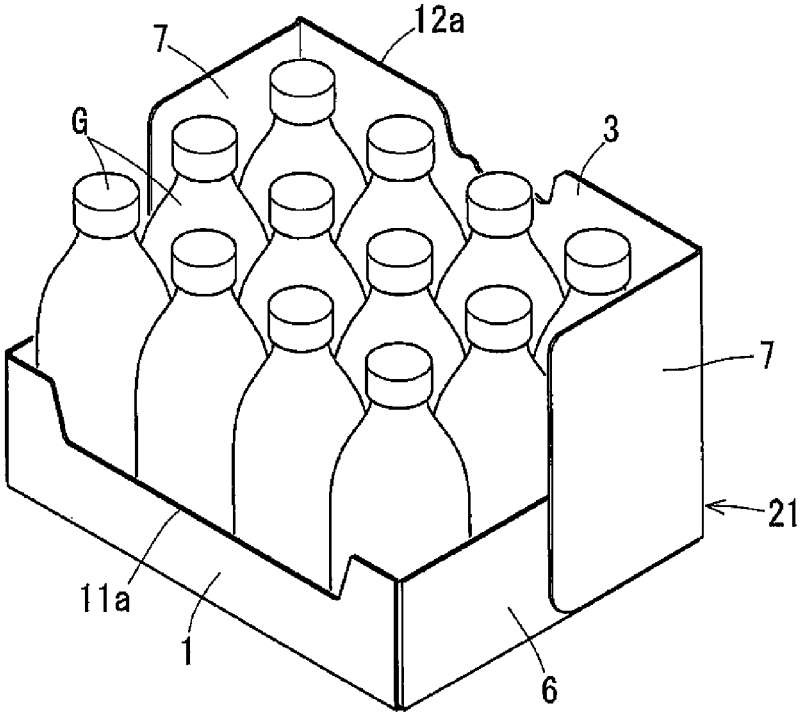
FIG. 13 is a perspective view illustrating the state in which products are exhibited in the tray portion of the box according to the third embodiment.

When products G are exhibited at a shop while received in the box, as in the first and second embodiments described above, it is possible to remove the lid portion 22 from the tray portion 21, and thus to visibly exhibit the products G in the tray portion 21 as illustrated in FIG. 13.

The box for packing and exhibiting a product according to the fourth embodiment of the present invention is now described with reference to FIGS. 14 to 17.

Figure 14:
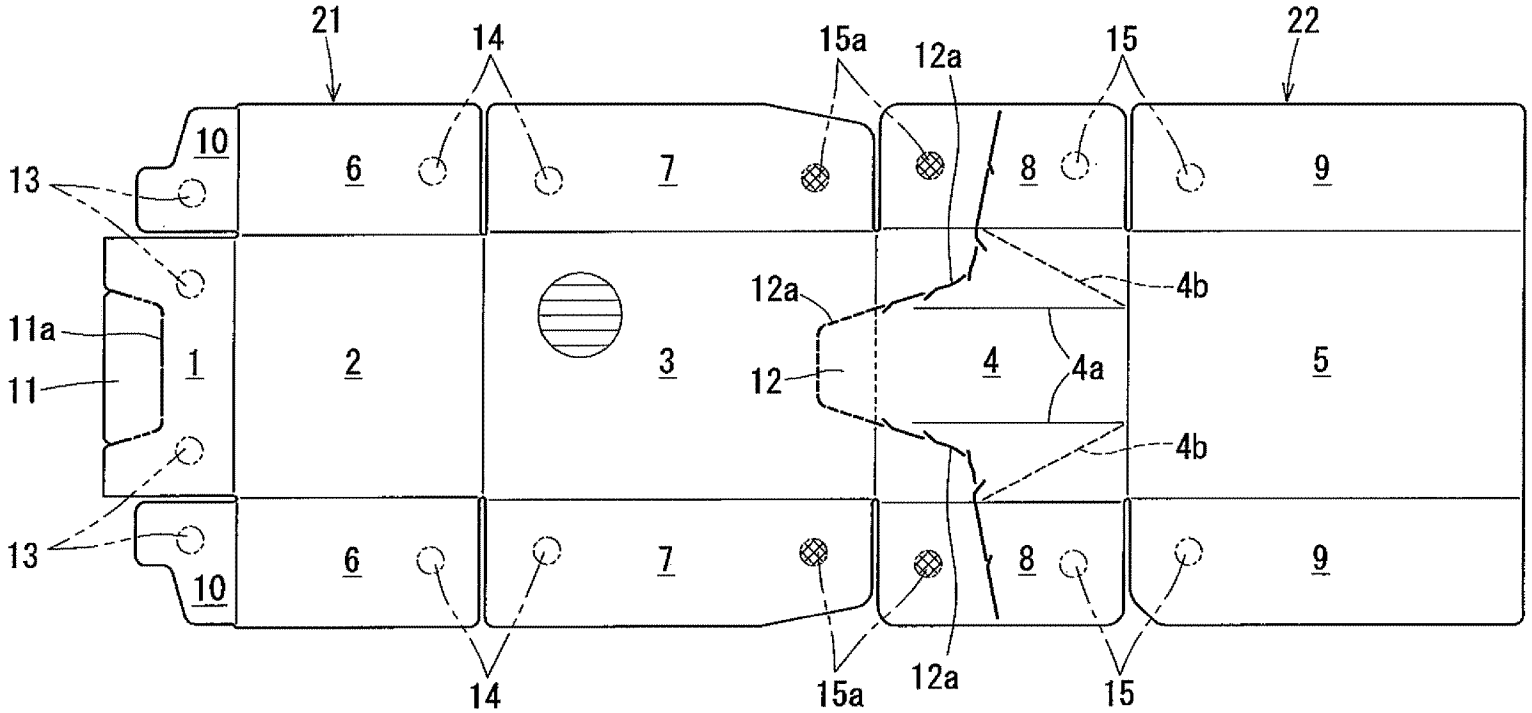
FIG. 14 is a view illustrating the blank of a box for packing and exhibiting a product according to a fourth embodiment of the present invention.

The box of the fifth embodiment has a height larger than its depth as in the above-described first and second embodiments, and is to be assembled from a blank as illustrated in FIG. 14. This blank includes a front receiving panel 1, a bottom surface panel 2, a rear surface panel 3, a top surface panel 4, and a front surface panel 5 that are integrally connected one to another in the direction of the corrugations of the paperboard. The blank further includes bottom side panels 6 integrally connected to the respective sides of the bottom surface panel 2, rear side panels 7 integrally connected to the respective sides of the rear surface panel 3, top side panels 8 integrally connected to the respective sides of the top surface panel 4, front side panels 9 integrally connected to the respective sides of the front surface panel 5, and coupling pieces 10 integrally connected to the ends of the respective bottom side panels 6 on the side of the front receiving panel 1.

The front receiving panel 1 is formed with a perforated cut line 11*a* extending from the distal end of the front receiving panel 1 such that a separable portion 11 having an inverted trapezoidal shape is formed inside of the cut line 11*a*. Though the cut line 11*a*, forming the peripheral edge of the separable portion 11, has joint portions, the bottom portion of the cut line 11 is almost completely cut. Therefore, when products are exhibited in the box, it is possible to easily separate the separable portion 11.

At the middle portion, in the width direction, of the rear surface panel 3 which includes the boundary between the rear surface panel 3 and the top surface panel 4, a push-in portion 12 having an inverted trapezoidal shape is defined by a portion of the cut line 12*a* that is formed in the rear surface panel 3 by perforations.

The cut line 12*a* further includes portions formed in the top surface panel 4 to extend from the portion of the cut line 12*a* formed around the push-in portion 12, away from the rear surface panel 3, and bent at intermediate portions thereof to extend to the boundaries between the top surface panel 4 and the respective top side panels 8. The cut line 12*a* further includes portions formed in the top side panels 8 to extend obliquely in a straight line from the respective portions of the cut line 12*a* formed in the top surface panel 4 to the middle portions of the distal end edges of the respective top side panels 8. The portions of the cut line 12*a* formed in the top surface panel 4 and the top side panels 8 are zipper-type line constituted by discontinuous hook-shaped cuts.

Also, the top surface panel 4 is formed with two normal scorelines 4*a* extending from the rear to front portion of the top surface panel 4 in parallel with the boundary lines between the top surface panel 4 and the respective top side panels 8 so as to pass through the portion of the top surface panel 4 located inside of the cut line 12*a*, and two reverse scorelines 4*b* obliquely extending from the respective ends of the cut line 12*a* on the respective sides of the top surface panel 4 to the front portions of the respective normal scorelines 4*a*. The normal scorelines 4*a* are ruled lines formed by pressing the inner surface of the corrugated paperboard. The reverse scorelines 4*b* are ruled lines formed by pressing the outer surface of the corrugated paperboard.

The front edges of the upper portions of the respective rear side panels 7, when the box is assembled, are obliquely cut according to the inclination of portions of the cut line 12*a* formed in the top side panels 8. Also, the front edges of the upper portions of the respective coupling pieces 10, when the box is assembled, are cut out according to the shape of the separable portion 11.

This blank is constituted by a tray portion 21 and a lid portion 22. The tray portion 21 is constituted by the front receiving panel 1, the bottom surface panel 2, the rear surface panel 3, the bottom side panels 6, the rear side panels 7, the coupling pieces 10, and the portions of the top side panels 8 located rearward of the cut line 12*a*, namely, on the side of the respective rear side panels 7. The lid portion 22 is constituted by the top surface panel 4, the front surface panel 5, the front side panels 9, and the portions of the top side panels 8 located forward of the cut line 12*a*, namely, on the side of the respective front side panels 9.

The tray portion 21 is assembled by bonding bond portions 13 of the front receiving panel 1 to bond portions 13 of the respective coupling pieces 10 by means of hot-melt adhesive, and bonding bond portions 14 of the bottom side panels 6 at their rear portions to bond portions 14 of the respective rear side panels 7 at their lower portions, by means of hot-melt adhesive. The lid portion 22 is assembled, by bonding bond portions 15 of the top side panels 8 at their portions located forward of the cut line 12*a* to bond portions 15 of the respective front side panels 9 at their upper portions, by means of hot-melt adhesive.

The tray portion 21 and the lid portion 22 are joined together by bonding bond portions 15*a* (netted portions in the drawings) of the top side panels 8 at their portions located rearward of the cut line 12*a* to bond portions 15*a* (netted portions in the drawings) of the respective rear side panels 7 at their upper portions.

Figure 15:
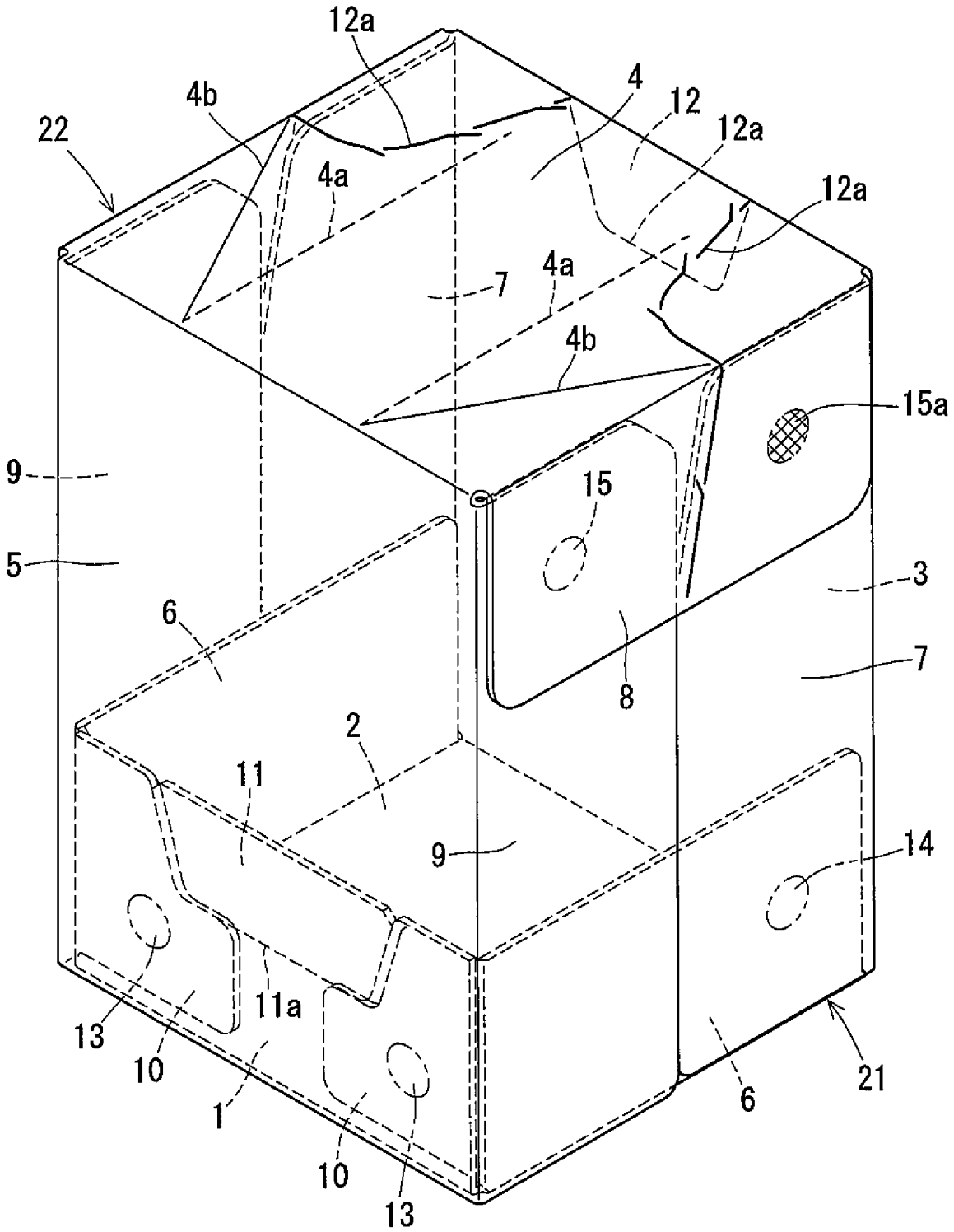
FIG. 15 is a perspective view illustrating the state in which products are packed in the box according to the fourth embodiment.

When such a blank is assembled so as to pack products in the box, as illustrated in FIG. 15, the front receiving panel 1, the bottom side panels 6, and the rear surface panel 3 are bent to stand relative to the bottom surface panel 2, the coupling pieces 10 are bent so as to extend along the inner surface of the front receiving panel 1, and the coupling pieces 10 and the front receiving panel 1 are bonded together at the respective bond portions 13, so that the front receiving panel 1 and the bottom side panels 6 are coupled together. Thereafter, the rear side panels 7 are bent forward, and the rear side panels 7 and the bottom side panels 6 are bonded together at the respective bond portions 14.

Thereafter, the top surface panel 4 is bent forward relative to the rear side panel 3, the front surface panel 5 is bent downwardly relative to the top surface panel 4, the front side panels 9 are bent rearward relative to the front surface panel 5, and the top side panels 8 are bent downwardly relative to the top surface panel 4. Then, the portions of the top side panels 8 located forward of the cut line 12*a* and the front side panels 9 are bonded together at the respective bond portions 15 by means of hot-melt adhesive, and the portions of the top side panels 8 located rearward of the cut line 12*a* and the rear side panels 7 are bonded together at the respective bond portions 15*a* by means of hot-melt adhesive.

With products packed in the box as described above, the portions of the cut line 12*a* formed in the top side panels 8 extend toward the respective abutment lines between the rear side panels 7 and the front side panels 9.

Figure 16:
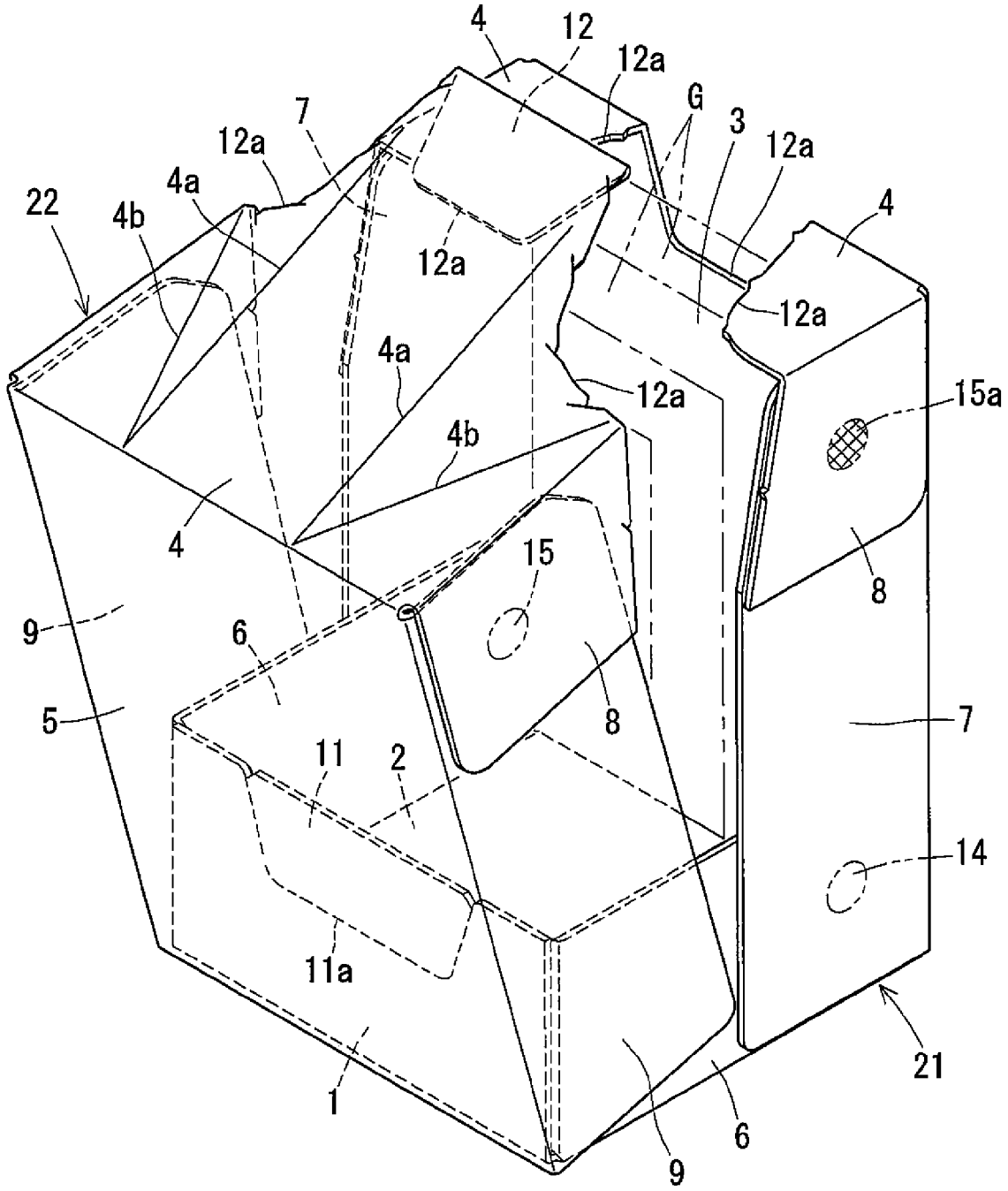
FIG. 16 is a perspective view illustrating the intermediate stage from the products-packed state to the products-exhibited state of the box according to the fourth embodiment.

When products are exhibited at a shop while received in the box, as illustrated in FIG. 16, the box is opened by separating the lid portion 22 from the tray portion. For this purpose, a user pushes in the push-in portion 12 of the rear surface panel 3 at its upper portion, thereby severing the push-in portion 12 along the cut line 12*a* formed around the push-in portion 12, inserts his/her fingers into the hole formed by pushing in the push-in portion 12, and pulls the rear portion of the top surface panel 4 forward such that top surface panel 4 is severed along the cut line 12*a*, and such that the top side panels 8 are also severed along the cut line 12*a*.

When the rear portion of the top surface panel 4 is pulled forward, since the top surface panel 4 is deflected such that its portion located between the portions of the cut line 12*a* formed in the top surface panel 4 bulges along the normal scorelines 4*a* and the reverse scorelines 4*b*, a large pulling force acts on the joint portions of the cut line 12*a*, thereby making it possible to easily sever the top surface panel 4 and the top side panels 8 along the cut line 12*a*.

Figure 17:
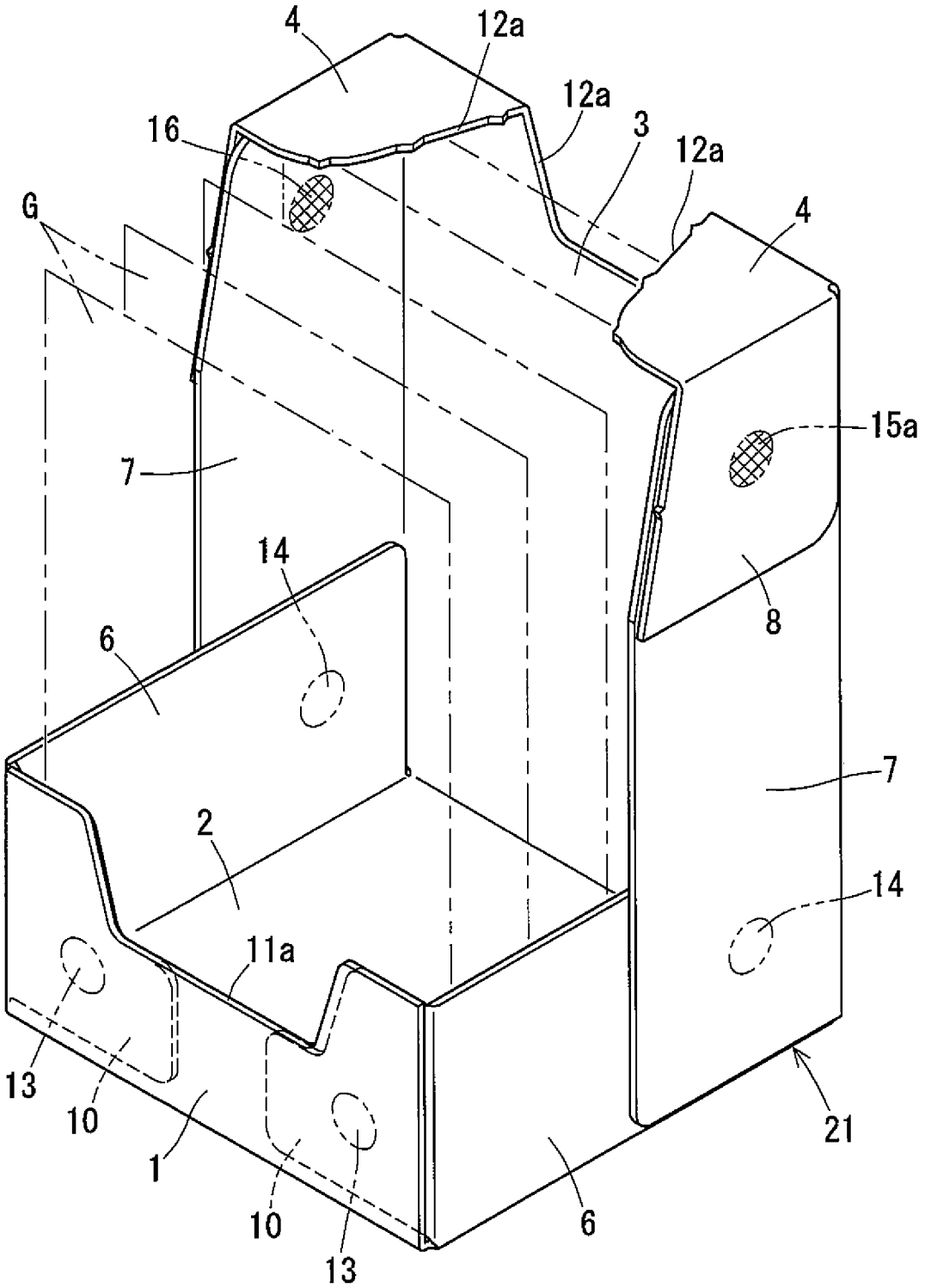
FIG. 17 is a perspective view illustrating the state in which products are exhibited in the tray portion of the box according to the fourth embodiment.

Thereafter, as illustrated in FIG. 17, the lid portion 22 is removed from the tray portion 21, and the separable portion 11 is separated, so that the products G received in the tray portion 21 are visibly exhibited. In this exhibition state, since the rear portions of the respective sides of the top surface panel 4 remain as crosspiece panels, it is possible to pile up a plurality of such tray portions 21, and to exhibit the products G in the respective tray portions 21. Also, the front receiving panel 1 can prevent the products G from moving out of the tray portion 21, and the rear surface panel 3 supports products G such that the products G can be exhibited while kept stable.

In this way, in the above box for packing and exhibiting a product, the tray portion 21 and the lid portion 22 are constituted by a one-piece blank, and when products are packed in the box, the lid portion 22 is fixed to the tray portion 21 only by basically bonding the portions of the top side panels 8 located rearward of the cut line 12*a* to the respective rear side panels 7. Therefore, only by pulling the lid portion 22 and severing the box along the cut line 12*a* extending from the top surface panel 4 to the respective top side panels 8, it is possible to open the box and exhibit the products in the box.

The portions of the cut line 12*a* formed in the top side panels 8 may extend to the end edges of the front sides of the respective top side panels 8. Alternatively, the portions of the cut line 12*a* formed in the top side panels 8 may be omitted, and the portions of the cut line 12*a* formed in the top side panel 4 may extend to the front ends of the boundaries between the top surface panel 4 and the respective top side panels 8.

In the above box for packing and exhibiting a product according to the first to fourth embodiments, as one example, the box is bonded at the respective bond portions by means of hot-melt adhesive and assembled so as to pack products in the box. However, instead of hot-melt adhesive, another adhesive or adhesive tape may be used so as to assemble the box.

Also, though the box is made of corrugated paperboard as one example, the box may be made of another sheet such as paperboard.

DESCRIPTION OF REFERENCE NUMERALS

1: front receiving panel
2: bottom surface panel
3: rear surface panel
4: top surface panel
4*a*: normal scoreline
4*b*: reverse scoreline
4*c*: push-in portion
4*d*, 4*e*: cut line
4*f*: reverse scoreline
5: front surface panel
6: bottom side panel
7: rear side panel
8: top side panel
8*a*: scoreline
9: front side panel
10: coupling piece
11: separable portion
11*a*, 12*a*: cut line
12: push-in portion
13, 14, 15, 15*a*, 16, 17: bond portion
17*a*: bond weakening portion
21: tray portion
22: lid portion
G: product
$a_1$ to $a_4$: adhesive nozzle
b: holding tool
c: pressing bar
d: sucker
g: guide bar

The invention claimed is:

1. A box for packing and exhibiting a product, the box comprising a tray portion and a lid portion, wherein the tray portion comprises:

a front receiving panel;

a bottom surface panel;

a rear surface panel;

bottom side panels integrally connected to respective sides of the bottom surface panel;

rear side panels integrally connected to respective sides of the rear surface panel; and coupling pieces integrally connected to ends of the respective bottom side panels on a side of the front receiving panel;

wherein the lid portion comprises:

a top surface panel;

a front surface panel;

top side panels integrally connected to respective sides of the top surface panel; and front side panels integrally connected to respective sides of the front surface panel, wherein the front receiving panel, the bottom surface panel, the rear surface panel, the top surface panel, and the front surface panel are each integrally connected to another of the front receiving panel, the bottom surface panel, the rear surface panel, the top surface panel, and the front surface panel, and configured to cover a product, wherein a first cut line for separating the lid portion from the tray portion is formed so as to pass through only an area of the rear surface panel, only an area of the top surface panel, or areas of both the rear surface panel and the top surface panel, wherein the front receiving panel is formed with a second cut line such that a separable portion is defined inside of the second cut line, wherein front edges of upper portions of the respective coupling pieces, when the box is assembled, are to be cut out according to a shape of the separable portion, wherein the box is configured such that with a product packed in the box, the front receiving panel and the rear surface panel are bent to stand relative to the bottom surface panel, the bottom side panels bent relative to the bottom surface panel and the rear side panels bent relative to the rear surface panel are bonded together, the coupling pieces bent relative to the respective bottom side panels are bonded to the front receiving panel such that the front receiving plate and the bottom side panels are coupled together, the top surface panel is bent forward relative to the rear surface panel, the front surface panel is bent downwardly relative to the top surface panel so as to be superposed on the front receiving panel, and the front side panels bent relative to the front surface panel and the top side panels bent relative to the top surface panel are bonded together, and wherein the box is further configured such that when a product is exhibited in the box, the box is severed along the first cut line, the lid portion is separated from the tray portion, and the box is severed along the second cut line such that the separable portion is separated from the front receiving panel.

2. The box according to claim 1, wherein the box is configured such that with a product packed in the box, the front receiving panel and a portion of the front surface panel overlapping with the front receiving panel are bonded together within the separable portion of the front receiving panel, wherein the box is further configured such that when a product is exhibited in the box, the box is severed along the second cut line such that the separable portion is separated from the front receiving panel while bonded to the front surface panel, and the lid portion is separated from the tray portion.

3. The box according to claim 1, wherein the first cut line extends in the top surface panel toward portions of the top surface panel located away from rear ends of boundaries between the top surface panel and the respective top side panels, and further extends in the top side panels toward open end edges of the respective top side panels, so that at least a portion of each of the top side panels constitutes the tray portion, and wherein the box is configured such that with a product packed in the box, the portions of the respective top side pates constituting the tray portion are bonded to the rear side panels.

4. The box according to claim 1, wherein the top surface panel is formed with two normal scorelines extending from a rear portion of the top surface panel to a front portion of the top surface panel between the first cut line, and with two reverse scorelines extending obliquely toward front portions of the respective normal scorelines from middle portions of respective sides of the top surface panel in a forward and rearward direction of the box.

5. The box according to claim 2, wherein the top surface panel is formed with two normal scorelines extending from a rear portion of the top surface panel to a front portion of the top surface panel between the first cut line, and with two reverse scorelines extending obliquely toward front portions of the respective normal scorelines from middle portions of respective sides of the top surface panel in a forward and rearward direction of the box.

6. The box according to claim 3, wherein the top surface panel is formed with two normal scorelines extending from a rear portion of the top surface panel to a front portion of the top surface panel between the first cut line, and with two reverse scorelines extending obliquely toward front portions of the respective normal scorelines from middle portions of respective sides of the top surface panel in a forward and rearward direction of the box.

7. A packing device for assembling the box according to claim 2 so as to pack a product in the box, wherein the packing device is configured to supply a blank of the box, bend the rear surface panel and the bottom side panels relative to the bottom surface panel, bend the rear side panels relative to the rear surface panel, store a product in the tray portion with the rear side panels bonded to the respective bottom side panels, and place the lid portion on the tray portion such that the front receiving panel and the portion of the front surface panel overlapping with the front receiving panel are bonded together within the separable portion of the front receiving panel.

8. The packing device according to claim 7, wherein the packing device is further configured, with the rear surface panel located at a bottom position of the box, to store products in the tray portion one after another from an open front surface side of the box, which now faces upward, such that the products pile up on an inner surface of the rear surface panel, bend, thereafter, the front receiving panel relative to the bottom surface panel, and bend the front surface panel relative to the top surface panel such that the front surface panel is bonded to the front receiving panel.

9. The packing device according to claim 7, wherein the packing device is further configured to bend the top surface panel relative to the rear surface panel after bending the rear side panels relative to the rear surface panel, store a product in the tray portion with the top side panels temporarily bent so as to overlap with the respective rear side panels, bend, thereafter, the front surface panel toward the front receiving panel, temporarily separate the top side panels from the respective rear side panels, bend the front side panels with the top side panels temporarily separated from the respective rear side panels, and thereafter, bend the top side panels such that the top side panels are superposed on outer surfaces of the respective rear side panels and on outer surfaces of the respective front side panels, and the top side panels are bonded to the respective front side panels.

10. The packing device according to claim 8, wherein the packing device is further configured to bend the top surface panel relative to the rear surface panel after bending the rear side panels relative to the rear surface panel, store a product in the tray portion with the top side panels temporarily bent so as to overlap with the respective rear side panels, bend, thereafter, the front surface panel toward the front receiving panel, temporarily separate the top side panels from the respective rear side panels, bend the front side panels with the top side panels temporarily separated from the respective rear side panels, and thereafter, bend the top side panels such that the top side panels are superposed on outer surfaces of the respective rear side panels and on outer surfaces of the respective front side panels, and the top side panels are bonded to the respective front side panels.

* * * * *